US007961208B2

(12) United States Patent
Suzuki et al.

(10) Patent No.: US 7,961,208 B2
(45) Date of Patent: Jun. 14, 2011

(54) IMAGE FORMING APPARATUS, IMAGE FORMING METHOD, AND IMAGE FORMING PROGRAM PRODUCT

(75) Inventors: Shinichi Suzuki, Kanagawa (JP); Kazumi Ishima, Kanagawa (JP); Minoru Morikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 501 days.

(21) Appl. No.: 12/094,558

(22) PCT Filed: Oct. 27, 2006

(86) PCT No.: PCT/JP2006/322054
§ 371 (c)(1),
(2), (4) Date: May 21, 2008

(87) PCT Pub. No.: WO2007/063676
PCT Pub. Date: Jun. 7, 2007

(65) Prior Publication Data

US 2009/0290009 A1 Nov. 26, 2009

(30) Foreign Application Priority Data

Nov. 30, 2005 (JP) ..... 2005-345872

(51) Int. Cl.
*B41J 2/435* (2006.01)

(52) U.S. Cl. ..... 347/234; 347/129

(58) Field of Classification Search ..... 347/233, 347/234, 129
See application file for complete search history.

(56) References Cited

U.S. PATENT DOCUMENTS

| | | | |
|---|---|---|---|
| 6,624,877 | B2 | 9/2003 | Uemura et al. |
| 6,744,491 | B2 | 6/2004 | Uemura et al. |

FOREIGN PATENT DOCUMENTS

| | | |
|---|---|---|
| JP | 7 248458 | 9/1995 |
| JP | 2001 88346 | 4/2001 |
| JP | 2002 72494 | 3/2002 |
| JP | 2002 144632 | 5/2002 |
| JP | 2004 147260 | 5/2004 |
| JP | 3604961 | 10/2004 |
| WO | WO 2004/082942 A1 | 9/2004 |

*Primary Examiner* — Huan H Tran
(74) *Attorney, Agent, or Firm* — Oblon, Spivak, McClelland, Maier & Neustadt, L.L.P.

(57) ABSTRACT

An image is formed by dividing rasterized original image data into regions in accordance with N recording heads, and scanning a recording body by simultaneously irradiating recording beams from the N recording heads. Corrected image data divided into regions in accordance with the recording heads are generated by changing the rasterized original image data based on information including positional displacements of the recording beams, so that the positional displacements are corrected. Scanning information is generated based on the positional displacement information. The scanning information includes positions and orders for the recording beams to scan the recording body to record the corrected image data.

15 Claims, 23 Drawing Sheets

IMAGE FORMING APPARATUS, IMAGE FORMING METHOD, AND IMAGE FORMING PROGRAM PRODUCT

TECHNICAL FIELD

The present invention relates to image forming apparatuses, image forming methods, and image forming program products employing plural recording heads, and in particular, to an image forming apparatus, an image forming method, and an image forming program product for correcting an inconsecutive portion in an image formed by plural recording heads.

BACKGROUND ART (Description of Terminology)

First, terminology used in the present invention is described.

<Recording Head>

A recording head records an image onto a recording body with a recording beam. For example, when the energy source is light, a laser beam irradiated from a laser light source is focused on the recording body with a lens. An image is formed by turning the laser beam on/off, forming portions on the recording body that react to light and portions that do not receive light.

An example of a recording head is shown in FIG. 1. The recording head shown in FIG. 1 includes a semiconductor laser LD 1, an aspherical lens 2, a diaphragm 3, and an adhesive 4.

<Recording Beam>

The recording head shown in FIG. 1 uses a laser beam as a recording beam. Generally, a recording beam records an image by transferring light, heat, impacts of a substance, or a substance itself such as ink, to a recording body.

<Recording Body>

A recording body reacts to energy from the recording head, and indicates different physical features at portions where energy is irradiated and portions where energy is not irradiated, thereby recording an image. For example, an image is recorded by chemical reaction, changes in phases, or changes in shape. Specifically, a recording body that uses light energy is made of a photosensitive material for reacting to light energy, a heat-sensitive material for reacting to heat of a laser beam, or reaction material that burns due to heat of a laser beam.

<Original Image Data>

Original image data represent an image to be formed by an image forming apparatus. For example, an image may be expressed by a page description language that specifies figures with characters formed by parameters of equations for dots and surfaces and parameters specifying character string codes and font types. Other examples are bitmap data of an arbitrary resolution or data of a page description language including bitmap data.

<Rasterization>

Rasterization means converting original image data to a set of dots (set of bits) that an image forming apparatus can record on a recording body. As a result of the conversion, 1 bit of rasterized data is recorded on the recording body as 1 dot. To output halftones, grayscales are converted to halftone dots, corresponding to a predetermined number of dots per unit area.

<Positional Displacement Information>

As shown in FIG. 2, when recording positions of recording heads are at ideal positions, recording regions of each of the recording heads on a recording body are arranged continuously with adjacent regions. However, in reality, due to manufacturing variations, the recording positions of the recording heads are arranged inconsecutively on the recording body, as indicated by solid lines shown in FIG. 3. Thus, an amount of positional displacement (x, y) between an ideal recording region and an actual recording region is obtained, as shown in FIG. 4. In this example, the ideal recording region is rectangular; a positional displacement amount can be a distance that vertex coordinates have moved. In this example, positional displacements from ideal vertex positions are obtained. However, in effect, as long as adjacent recording regions are arranged continuously and are not displaced from each other, the recorded image appears fine. Accordingly, the positional displacement amount can be a relative distance between pixels of adjacent recording regions, which pixels are ideally adjacent to each other. Regardless of how the displacement amount is expressed, positional displacement information represents an inconsecutive region, i.e., a gap appearing at a boundary between adjacent regions corresponding to adjacent recording heads in a recorded image.

The positional displacement information varies between different image forming apparatuses. Accordingly, a reference image (marker) is plotted on the recording body, and positional displacement information is obtained based on the plotted reference image.

In FIG. 5, marks of an original (M1, M2) are recorded on a recording body. Each mark is recorded in one of the recording regions of two recording heads. The marks recorded by the two recording heads are compared with original marks (marks on the original), so as to detect a positional displacement therebetween.

In FIG. 5, the positional displacement is detected from a positional relationship v0 between marks on the original and a positional relationship v1 between marks recorded on the recording body. Thus, a relative positional displacement between the two recording heads can be detected.

<Scanning Information>

Scanning information corresponds to data expressing a position at which image data are to be recorded when forming an image. When there are N scanning lines, scanning positions from the left are expressed as L [1], L [2] . . . L[N]. Normally, position information is expressed as 1, 2, 3 . . . N for L[1], L[2] . . . L[N].

In order to increase scanning density, three scanning lines evenly spaced apart can be added in between scanning line L[1] and scanning line L[2], for example. When the added scanning lines are included, the positional information for L[1], L[2], L[3] . . . is 1, 1.25, 1.5, 1.75, 2, 3 . . . N.

The scanning information also includes height information Lh for determining a position from which scanning starts (scanning start position), to be described below.

<Step Scanning>

As shown in FIG. 6, in a step scanning method, a movable stage 15 stops while a recording body 11 wrapped around a rotating drum 12 is facing recording heads 16. The movable stage 15 moves to the next scanning position when a non-recording portion of the rotating drum 12 is facing the recording heads 16.

<Spiral Scanning>

As shown in FIG. 7, in a spiral scanning method, the movable stage is constantly moving while the drum is rotating. Normally, the movable stage moves at a speed such that one main scanning line is scanned during one rotation of the drum. Accordingly, the surface of the drum can be scanned in a spiral manner.

(Conventional Image Forming Apparatus)

Next, an example of a conventional image forming apparatus is described with reference to FIG. 6.

The image forming apparatus employing the step scanning method shown in FIG. 6 includes the recording body 11, the drum 12, a drum encoder 14, the movable stage 15 that moves in parallel with the drum 12, the recording heads 16 provided on the movable stage 15, and a rotational axle 17. Recording beams irradiated from the recording heads 16 scan the recording body 11 to form an image.

The recording body 11 is a recording material used for image formation, and is wrapped around the surface or the underside of the circumference of the drum 12. The recording body 11 is fixed to the circumferential surface of the drum 12 with a fixing mechanism such as a clamping mechanism. The drum 12 is rotatable around the rotational axle 17, and is rotated by not shown driving means attached to the rotational axle 17. In order to accurately control the rotation of the drum 12, a stepping motor or a servo motor is employed as the driving means.

The drum encoder 14 is provided on one end of the drum 12. The drum encoder 14 includes a light source and a light detecting device that detects light irradiated from the light source, so as to detect the rotational position of the rotating drum 12. Further, the drum encoder 14 can detect the home position of the drum 12, i.e., the position from which the drum 12 starts rotating.

The movable stage 15 is movable in the axial direction of the drum 12, under control of a ball screw or a linear motor. A scan trajectory 13 moves in accordance with the movement of the movable stage 15.

The image forming apparatus shown in FIG. 6 operates as follows.

The drum 12 is rotated by a power source such as a motor. As described above, the drum encoder 14 detects the rotational position of the drum 12. Specifically, positions of the recording body 11 and the recording heads 16 can be obtained from output from the drum encoder 14. Based on the obtained positions, a recording timing to perform recording onto the recording body 11 is determined.

The image forming apparatus detects the home position of the drum 12 with the drum encoder 14, and the recording heads 16 start recording an image. With one rotation of the drum 12, each recording head 16 scans one line. This is referred to as main scanning.

When one main scanning operation on the recording body 11 is completed, the movable stage 15 moves horizontally to the position of the next main scanning operation; this is referred to as sub scanning. Subsequently, main scanning is performed. Recording beams from the recording heads 16 scan the recording body 11 by alternately repeating sub scanning and main scanning. When scanning of a predetermined region on the recording body 11 is completed, the process of creating an image is completed.

In the above example, sub scanning is performed every time the drum 12 rotates once, i.e., in a stepwise manner. Instead of a stepwise manner, it is also possible to perform sub scanning substantially continuously, so that the recording body 11 is scanned in a spiral manner. The image forming apparatus described with reference to FIG. 7 performs sub scanning in a spiral manner. In the image forming apparatus described with reference to FIG. 7, the movable stage that moves the recording heads is constantly moving at a speed such that one main scanning line is scanned during one rotation of the drum.

(Conventional Technology)

A technology disclosed in Japanese Laid-Open Patent Application No. 2001-88346 (Patent Document 1) is described with reference to FIG. 8. A laser beam L1 and a laser beam L2 irradiated from adjacent recording heads continuously record images in recording regions A1 and A2. In a recording region C12, the number of main scanning lines recorded by the laser beam L1 is gradually reduced, while the number of main scanning lines recorded by the laser beam L2 is gradually increased, so that the boundary between adjacent recording regions A1, A2 in the image is inconspicuous.

In an invention described in Japanese Laid-Open Patent Application No. 2002-72494 (Patent Document 2), an image is divided into plural segments to be recorded by plural laser beams, and the sub scanning speed is reduced near boundaries of adjacent images so as to adjust intervals between main scanning lines. The main scanning lines are divided in the main scanning direction, and are separated and formed in a sub scanning direction, so that differences between inclinations of the main scanning lines are eliminated. Accordingly, high quality images can be recorded at high speed.

In an invention described in Japanese Laid-Open Patent Application No. 2004-147260 (Patent Document 3), when one set of original image data is divided so that image formation is performed by plural recording heads, positional displacements of the divided parts can be corrected by a simple method. Specifically, a single set of image data can be divided into plural parts based on image regions corresponding to the recording heads, so as to create divided image data. According to positional displacements of the divided images, a new correction image data area is additionally provided based on the divided image data and detection results of positional displacement amounts. The divided image data are arranged in the correction image data area based on positions obtained from detection results of the positional displacement amounts. Thus, positional displacements between divided images are prevented.

In an invention described in Japanese Patent No. 3604961 (Patent Document 4), a print region on a recording medium or an intermediate recording medium, in which image information is actually recorded, is divided into at least two segments. The segments are superposed onto each other at boundary parts. A relative positional difference detecting unit exposes three or four positional marks onto an exposure area including the superposed regions, and calculates a positional displacement amount of the exposure area from a detected value of a positional displacement amount between the positional marks. Image information forming units form image information based on positional displacement amounts of the exposure area. An image information correcting unit corrects the image information so as to match the actual print region.

Patent Document 1: Japanese Laid-Open Patent Application No. 2001-88346

Patent Document 2: Japanese Laid-Open Patent Application No. 2002-72494

Patent Document 3: Japanese Laid-Open Patent Application No. 2004-147260

Patent Document 4: Japanese Patent No. 3604961

In the invention described in Japanese Laid-Open Patent Application No. 2001-88346, in a recording region where images recorded by, adjacent recording beams are superposed, the number of main, scanning lines recorded by one laser beam is gradually reduced, while the number of main scanning lines recorded by another laser beam is gradually increased, so that the boundary between adjacent images is inconspicuous. However, in this method, intervals between scanning lines from the two laser beams are not adjusted at all.

Therefore, if a positional displacement between the two laser beams is half of the scanning intervals, stripes may appear at boundaries between scanning lines from different laser beams. In such a case, as there are boundaries throughout the entire superposed region, the number of stripes is increased, and image quality is degraded.

In the invention described in Japanese Laid-Open Patent Application No. 2002-72494, the sub scanning speed is reduced near boundaries of adjacent images to adjust intervals between main scanning lines, so that inconsecutive portions at boundaries are inconspicuous. However, in order to reduce the sub scanning speed in spiral scanning, extra processes are necessary to eliminate differences between inclinations of the main scanning lines. Specifically, the processes include dividing the main scanning lines in a main scanning direction so as to be separated and formed in a sub scanning direction. Further, when performing processes to correct inclinations of plural main scanning lines, interference may occur between the number of main scanning lines subject to inclination correction and periods of area modulation patterns, used for expressing image density. Accordingly, stripes may be visible at boundaries of images. Further, by reducing the sub scanning speed, the friction resistance of stage machine parts for sub scanning, e.g., a guide rail, deviates from normal values. Accordingly, the driving torque of the driving source deviates from normal values. Thus, precision of scanning positions varies between segments scanned at normal speed and segments scanned at reduced speed; therefore, fine stripes may be visible in the resultant image.

In the invention described in Japanese Laid-Open Patent Application No. 2004-147260, embedded images are provided for each recording head to measure positional displacements, which makes the structure complex. Further, fractional parts of positional displacements are not taken into account; therefore, the positional displacements are not thoroughly corrected.

The invention described in Japanese Patent No. 3604961 involves exposing three or four positional marks onto the exposure area, which makes the structure complex.

Accordingly, there is a need for an image forming apparatus, an image forming method, and an image forming program product in which positional displacements of images recorded by adjacent recording heads can be corrected in main scanning and sub scanning directions without changing the sub scanning speed, and differences in recording densities between recording heads are not visible in recorded images.

DISCLOSURE OF THE INVENTION

The present invention provides an image forming apparatus, an image forming method, and an image forming program product in which one or more of the above-described disadvantages is eliminated.

An embodiment of the present invention provides an image forming apparatus for forming an image corresponding to rasterized original image data by dividing the rasterized original image data into regions in accordance with N (N being an integer greater than or equal to 2) recording heads, and scanning a single recording body by simultaneously irradiating recording beams from the N recording heads, the image forming apparatus including a positional displacement information storing unit configured to hold positional displacement information including positional displacements of the recording beams of the recording heads; a rasterized original image data storing unit configured to hold the rasterized original image data; a corrected image data generating unit configured to generate corrected image data divided into the regions in accordance with the recording heads, the corrected image data being obtained by changing the rasterized original image data held in the rasterized original image data storing unit based on the positional displacement information so that the positional displacements are corrected in a main scanning direction and a sub scanning direction when the recording beams are irradiated; and a scanning information generating unit configured to generate scanning information based on the positional displacement information, the scanning information including positions and orders for the recording beams to scan the recording body to record the corrected image data.

An embodiment of the present invention provides an image forming apparatus for forming an image, corresponding to rasterized original image data by dividing the rasterized original image data into regions in accordance with N (N being an integer greater than or equal to 2) recording heads, and scanning a single recording body by simultaneously irradiating recording beams from the N recording heads, the image forming apparatus including a positional displacement information storing unit configured to hold positional displacement information including positional displacements of the recording beams of the recording heads; a rasterized original image data storing unit configured to hold the rasterized original image data; a corrected image data generating unit configured to generate corrected image data divided into the regions in accordance with the recording heads, the corrected image data being obtained by changing the rasterized original image data held in the rasterized original image data storing unit based on the positional displacement information so that the positional displacements are corrected in a main scanning direction and a sub scanning direction when the recording beams are irradiated; and a scanning information generating unit configured to generate scanning information based on the positional displacement information, the scanning information including positions and orders for the recording beams to scan the recording body to record the corrected image data; wherein the scanning information generating unit generates the scanning information so as to provide a high density area near a scanning start position or a scanning end position, wherein scanning density is higher in the high density area than in other areas scanned, additional scanning operations performed for the high density area are extracted and grouped together according to predetermined intervals, and sub scanning operations are performed for each group between performing main scanning operations, the sub scanning operations being performed for the groups at substantially equal speeds.

An embodiment of the present invention provides an image forming method of forming an image corresponding to rasterized original image data by dividing the rasterized original image data into regions in accordance with N (N being an integer greater than or equal to 2) recording heads, and scanning a single recording body by simultaneously irradiating recording beams from the N recording heads, the image forming method including the steps of (a) generating corrected image data divided into the regions in accordance with the recording heads, the corrected image data being obtained by changing the rasterized original image data based on previously stored positional displacement information including positional displacements of the recording beams of the recording heads, so that the positional displacements are corrected in a main scanning direction and a sub scanning direction when the recording beams are irradiated; and (b) generating scanning information based on the positional displacement information, the scanning information including positions and orders for the recording beams to scan the recording body to record the corrected image data.

An embodiment of the present invention provides an image forming method of forming an image corresponding to rasterized original image data by dividing the rasterized original image data into regions in accordance with N (N being an integer greater than or equal to 2) recording heads, and scanning a single recording body by simultaneously irradiating recording beams from the N recording heads, the image forming method including the steps of (a) generating corrected image data divided into regions in accordance with the recording heads, the corrected image data being obtained by changing the rasterized original image data based on previously stored positional displacement information including positional displacements of the recording beams of the recording heads, so that the positional displacements are corrected in a main scanning direction and a sub scanning direction when the recording beams are irradiated; and (b) generating scanning information based on the positional displacement information, the scanning information including positions and orders for the recording beams to scan the recording body to record the corrected image data; wherein the step (b) includes generating the scanning information so as to provide a high density area near a scanning start position or a scanning end position, wherein scanning density is higher in the high density area than in other areas scanned, additional scanning, operations performed for the high density area are extracted and grouped together according to predetermined intervals, and sub scanning operations are performed for each group between performing main scanning operations, the sub scanning operations being performed for the groups at substantially equal speeds.

According to one embodiment of the present invention, an image forming apparatus, an image forming method, and an image forming program product are provided, in which positional displacements of images recorded by adjacent recording heads can be corrected in main scanning and sub scanning directions without changing the sub scanning speed, and differences in recording densities between recording heads are not visible in recorded images.

BEST MODE FOR CARRYING OUT THE INVENTION

A description is given, with reference to the accompanying drawings, of an embodiment of the present invention.

First Embodiment

The basic principle of a first embodiment according to the present invention is described with reference to FIGS. 9A, 9B, 9C.

Figure 9A:
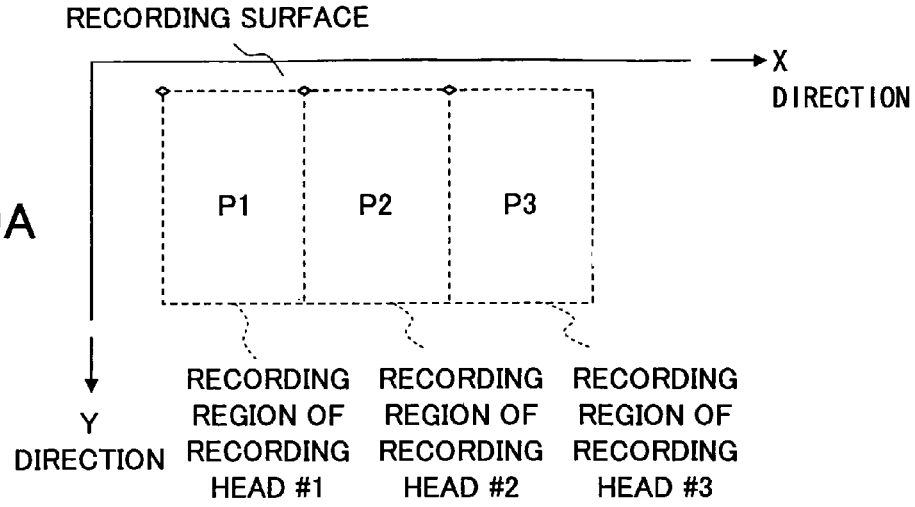
FIGS. 9A, 9B, 9C are diagrams for describing the basic principle of a first embodiment according to the present invention.

FIG. 9A shows ideal recording regions of three recording heads (first recording head, second recording head, third recording head).

P1 is the recording region of the first recording head, P2 is the recording region of the second recording head, and P3 is the recording region of the third recording head. In FIGS. 9A, 9B, 9C, a vertical direction (Y direction) is referred to as a main scanning direction, and a horizontal direction (X direction) is referred to as a sub scanning direction.

In FIG. 9A, rasterized original image data are correctly reproduced. However, in reality, image data are recorded by the recording heads as indicated by solid lines shown in FIG. 9B. H1 denotes the actual recording region of the first recording head, H2 denotes the actual recording region of the second recording head, and H3 denotes the actual recording region of the third recording head. Accordingly, the first recording head irradiates a recording beam before the ideal position by a distance X1, and the second recording head irradiates a recording beam behind the ideal position by a distance X2 and at a position displaced in the sub scanning direction by a distance Y1. The third recording head irradiates a recording beam in an ideal recording region.

Figure 9B:
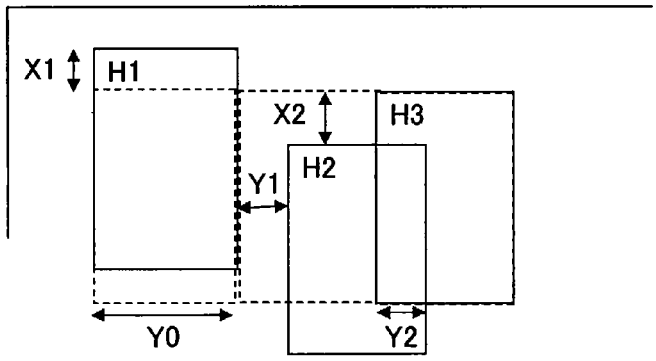

In the status shown in FIG. 9B, there is a blank area (Y1) and a superposed area (Y2), and the top parts of the recording regions are not aligned.

Figure 9C:
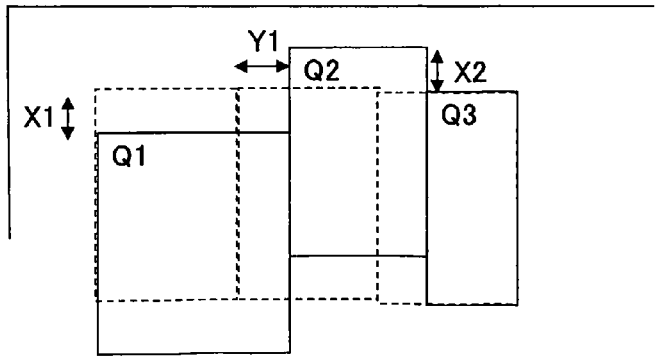

In order to change the status shown in FIG. 9B to a status shown in FIG. 9C, the blank area (Y1) is included in the recording region of the first recording head, the first recording head is made to irradiate a recording beam behind the ideal position by the distance X1, and the second recording head is made to irradiate a recording beam before the ideal position by the distance X2.

By recording the image data shown in FIG. 9C with the recording heads having properties as shown in FIG. 9B (in addition, the recording region of the first recording head is widened by the distance Y1), the original image data can be correctly reproduced.

A detailed description of the first embodiment is given below.

(Block Diagram of Image Forming Apparatus)

Figure 6:
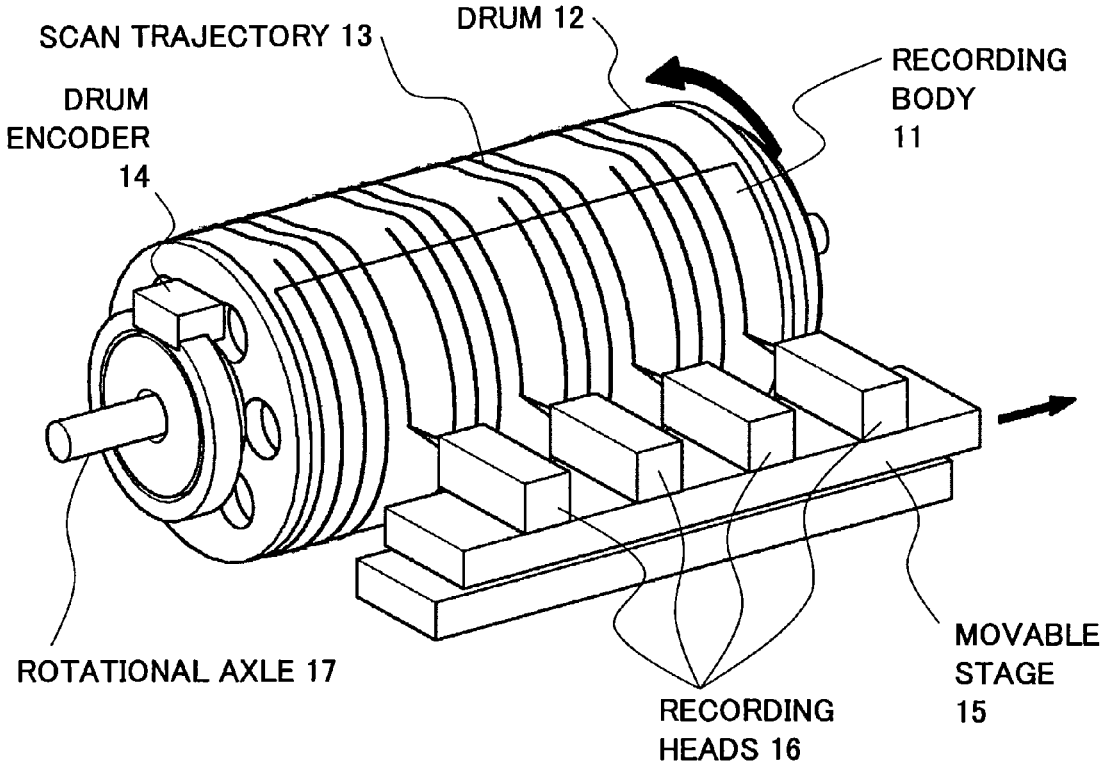
FIG. 6 is a perspective view of an image forming apparatus that performs a step scanning method.
Figure 7:
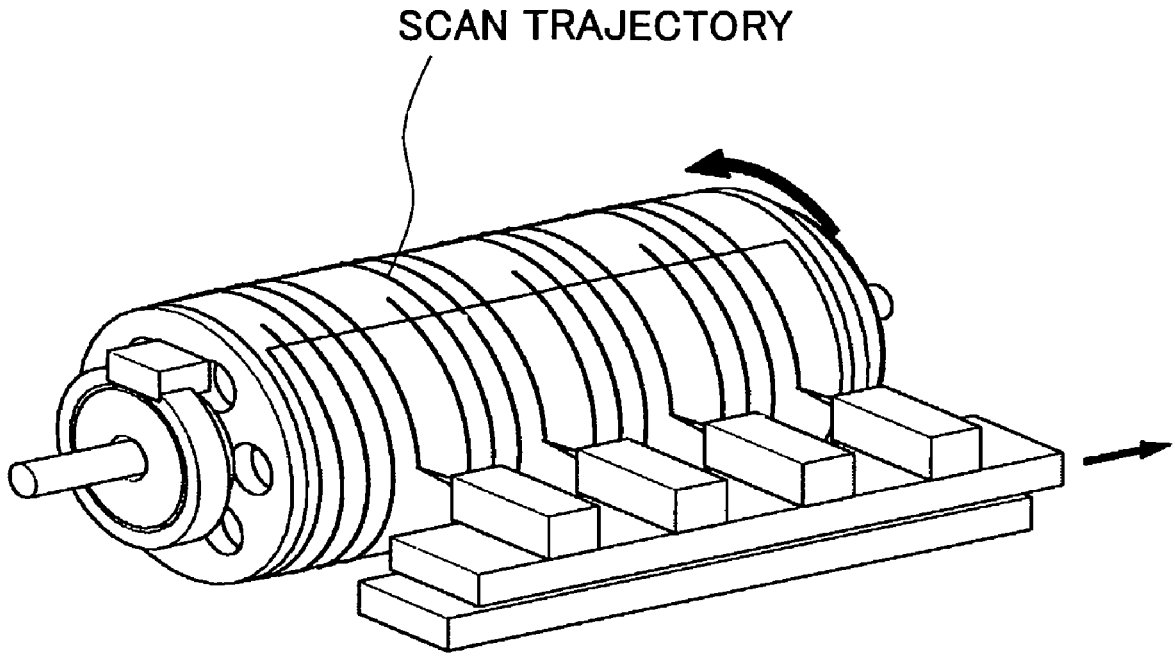
FIG. 7 is a perspective view of an image forming apparatus that performs a spiral scanning method.
Figure 8:
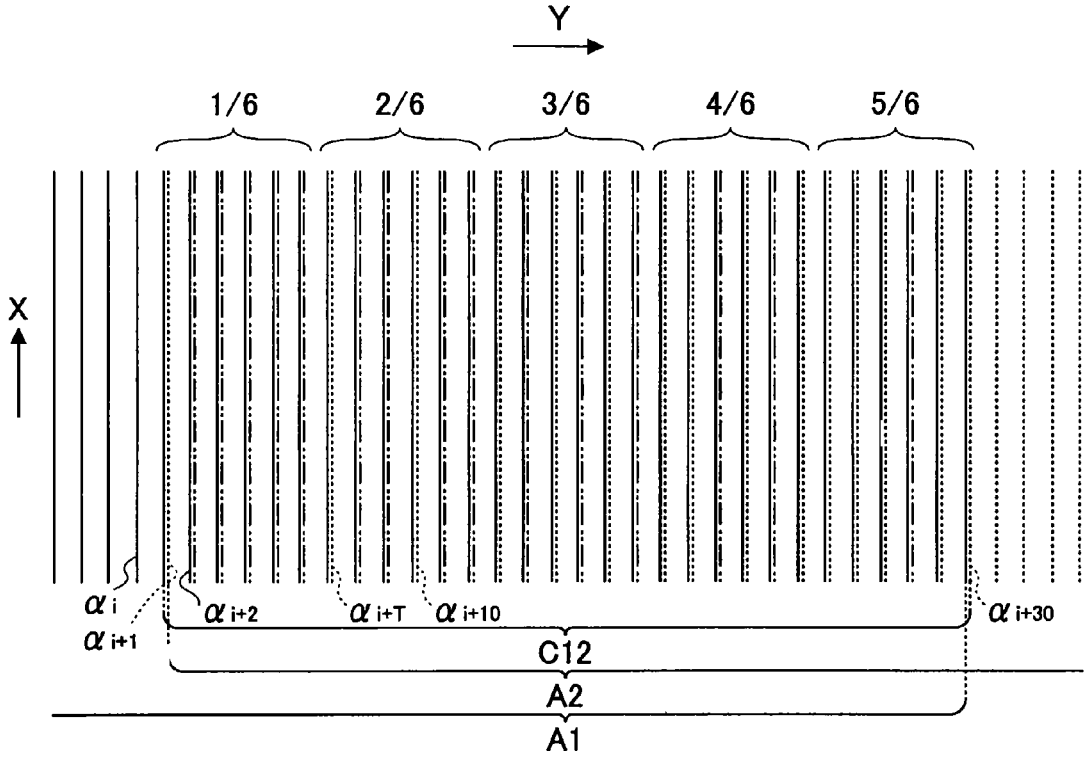
FIG. 8 is a diagram for describing a conventional technology.

An image forming apparatus according to the first embodiment is assumed to have a structure similar to that described with reference to FIG. 6.

Figure 10:
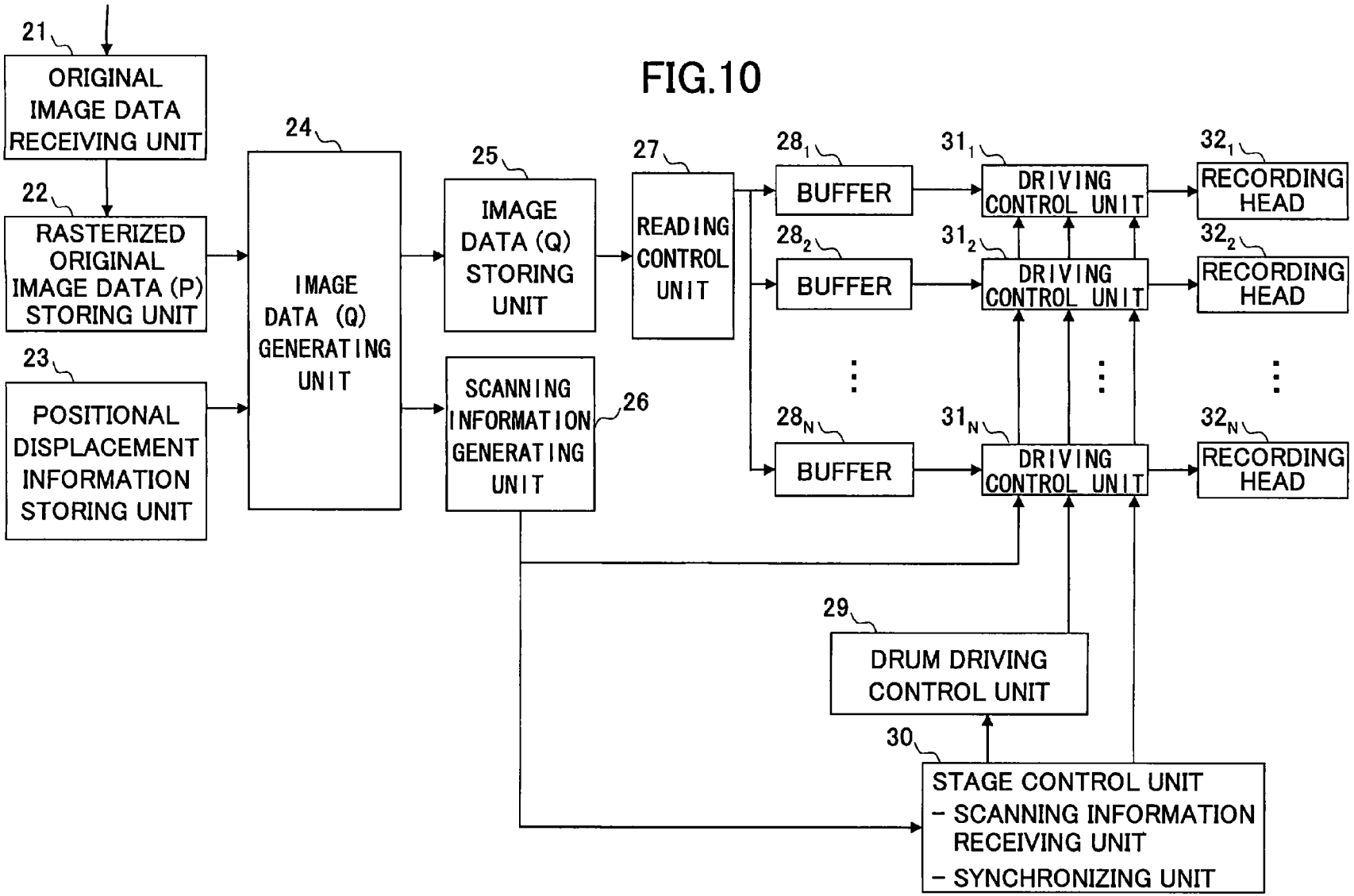
FIG. 10 is a functional block diagram of an image forming apparatus according to the first embodiment of the present invention.

FIG. 10 is a block diagram of the image forming apparatus according to the first embodiment. The image forming apparatus shown in FIG. 10 includes an original image data receiving unit 21, a rasterized original image data (P) storing unit 22, a positional displacement information storing unit 23, an image data (Q) generating unit 24, an image data (Q) storing unit 25, a scanning information generating unit 26, a reading control unit 27, buffers $\mathbf{28}_1$, through $\mathbf{28}_N$, a drum driving control unit 29, a stage control unit 30, driving control units $\mathbf{31}_1$, through $\mathbf{31}_N$, and recording heads $\mathbf{32}_1$, through $\mathbf{32}_N$.

The original image data receiving unit 21 receives original image data of images to be formed by the image forming apparatus. The received data, i.e., rasterized original image data (P), are loaded in the rasterized original image data (P) storing unit 22.

The positional displacement information storing unit 23 holds positional displacement information. In the first embodiment, a reference image (marker) is actually plotted on a recording body beforehand, and the plotted image (marker) is used for measuring positional displacement of a recording beam from the recording head 32. The positional displacement information is obtained based on the measured positional displacement, and is loaded in the positional displacement information storing unit 23.

The rasterized original image data (P) loaded in the rasterized original image data (P) storing unit 22 are recorded by the recording heads 32, based on positional displacement information loaded in the positional displacement information storing unit 23. Before the data are actually recorded, the image data (Q) generating unit 24 can change the rasterized original image data (P) into the image data (Q), in order to correct positional displacements in the main scanning direction and/or the sub scanning direction. The image data (Q) obtained by changing the rasterized original image data (P) are loaded in the image data (Q) storing unit 25.

The reading control unit 27 reads pixels of the image data (Q) loaded in the image data (Q) storing unit 25, and sequentially transfers the pixels to the buffers $\mathbf{28}_1$, through $\mathbf{28}_N$. Upon sequentially receiving the image data (Q), the buffers $\mathbf{28}_1$, through $\mathbf{28}_N$ temporarily store a predetermined number of lines (at least one line) in association with the recording heads $\mathbf{32}_1$, through $\mathbf{32}_N$.

Figure 11:
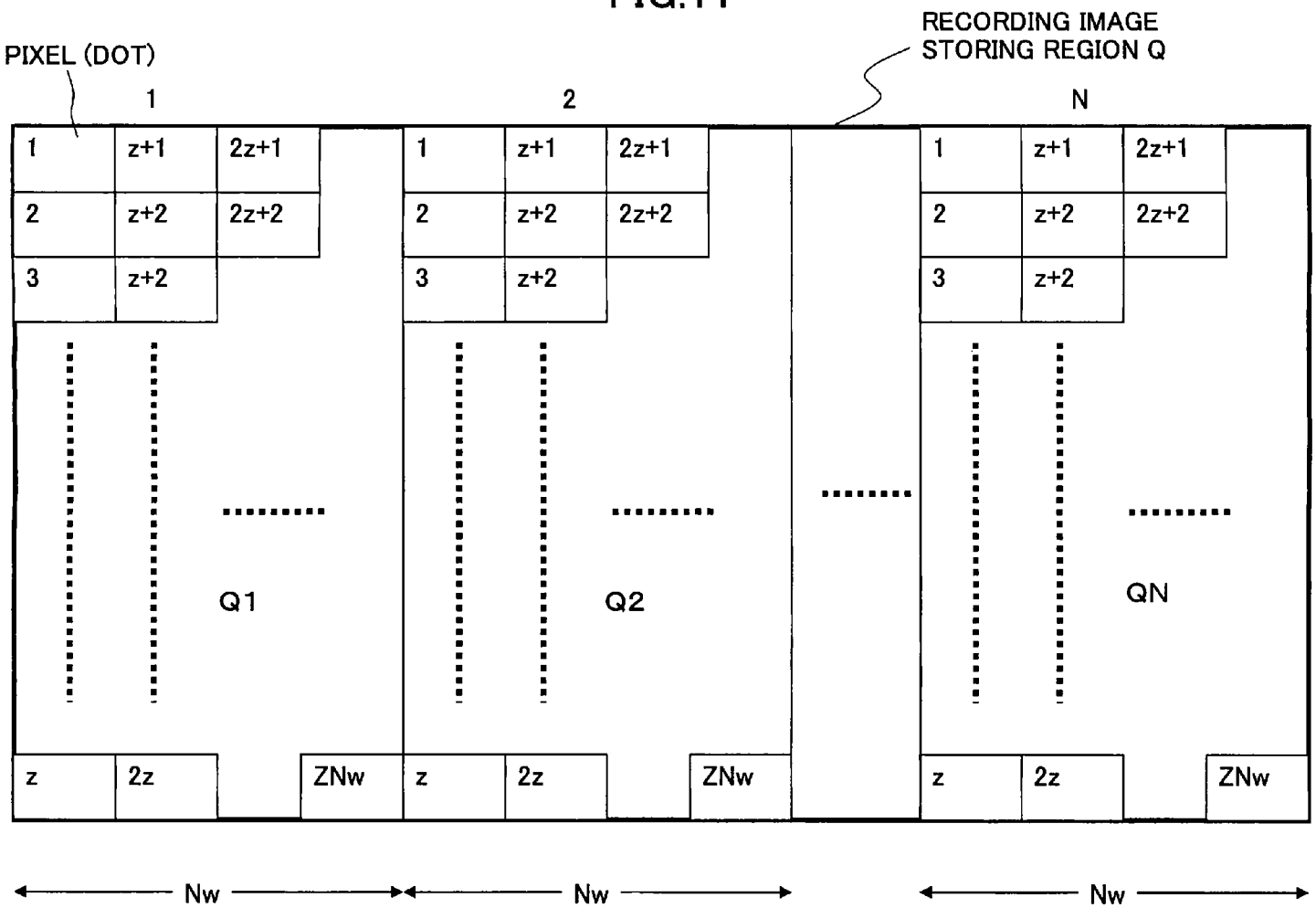
FIG. 11 is a schematic diagram of a recording image storing region Q.

As shown in FIG. 11, the image data (Q) storing unit 25 includes a recording image storing region Q, which is a region for storing an image to be recorded. The recording image storing region Q holds image data (Q), which are divided into N parts, in association with the N recording heads.

A storing region Q1 is associated with the first recording head $\mathbf{32}_1$, a storing region Q2 is associated with the second recording head $\mathbf{32}_2$, and a storing region QN is associated with the Nth recording head $\mathbf{32}_N$.

Each of the storing regions Q1 through QN has z bits in the main scanning direction and $Z_W$ bits in the sub scanning direction (a total of z bits×$Z_W$ bits).

The reading control unit 27 reads pixels in each of the storing regions Q1 through QN in the order of 1, 2, 3 . . . z, z+1, z+2, z+3 . . . 2z, . . . z×Nw, and transfers the pixels to the corresponding buffers $\mathbf{28}_1$, through $\mathbf{28}_N$.

The bits "1, 2, . . . z" in the storing region Q1 are written onto a recording body by a first scan (hereinafter, "L[1]"), and the bits "z+1, z+2, . . . z+z" are written onto a recording body by a second scan (hereinafter, "L[2]"), and so forth.

The scanning information generating unit 26 generates scanning information corresponding to the image data (Q) loaded in the image data (Q) storing unit 25. Based on the scanning information, the drum driving control unit 29 and the stage control unit 30 perform main scanning and sub scanning.

The scanning information generated by the scanning information generating unit 26 is transferred to the stage control unit 30 and the driving control units 31. The stage control unit 30 causes the movable stage to move according to the order of the scanning information. Specifically, the stage control unit 30 receives the scanning information, and determines the position of the movable stage. First, the stage control unit 30 moves the movable stage to the position of the first scan L[1], and every time the drum rotates once, the movable stage is moved to a position corresponding to the next scanning information, such as the position of the second scan L[2], the position of the third scan L[3], and so forth. The movable stage is moved when facing regions of the drum where images are not recorded and recording beams are not irradiated. For example, the movable stage is moved in synchronization with a home position signal of the drum. When the movable stage moves to a scanning position, image data associated with the scanning information corresponding to the scanning position are recorded onto the drum. The driving control unit 31 drives the recording head 32, and turns on/off a recording beam in accordance with image data. Main scanning is performed by the rotation of the drum, and sub scanning is performed by the movement of the movable stage.

The stage control unit 30 controls the movable stage on which the recording heads 32 are mounted, and has functions of synchronizing with the drum driving control unit 29 in accordance with scanning information, and receiving scanning information.

The configuration shown in FIG. 10 is also applicable to other embodiments.

Next, a description is given of a process performed by the image data (Q) generating unit 24 according to the first embodiment. Specifically, the image data (Q) generating unit 24 changes rasterized original image data (P) loaded in the rasterized original image data (P) storing unit 22 into image data (Q) loaded in the image data (Q) storing unit 25.

(Rasterized Original Image Data (P) and Image Data (Q))

An original raster image storing region P of the rasterized original image data (P) storing unit 22 holds rasterized original image data (P). The image data (Q) generating unit 24 changes the rasterized original image data (P) into the image data (Q), and loads the image data (Q) into the recording image storing region Q of the image data (Q) storing unit 25.

As a matter of simplification, it is assumed that the number "N" of the recording heads 32 is four. The recording heads 32 are mounted onto the movable stage movable in an axial direction of the drum. The recording heads 32 are referred to as R[1], R[2], R[3], R[4], from the left of the axial direction of the drum. Recording beams irradiated from the recording heads 32 are referred to as Rb1, Rb2, Rb3, Rb4, from the left of the axial direction of the drum. The recording beams irradiated from the plural recording heads 32 are arranged so as to irradiate the recording body 11 in a linear manner along the axial direction of the drum, with substantially equal intervals therebetween. If sub scanning is recorded in a direction from left to right, Rb1 is positioned on the left side outside a left edge of a recording body recording region, before image recording starts. Accordingly, the entire recording region of the recording body 11 can be scanned.

In the first embodiment, the recording heads 32 are spaced apart by intervals of 100 mm. A prescribed image recording density p is 1 line/mm. Therefore, a prescribed recording width w allocated to each recording head is 100 mm, such that 100 lines are scanned. With four recording heads, an image with a width of 400 mm is recorded. The drum diameter is 200 mm. The drum circumference is approximately 628 mm. The recording circumference on the recording body 11 is 500 mm.

Thus, the size of an image to be recorded (hereinafter, "recording image size") is 400 mm in width and 500 mm in height. Hereinafter, the axial direction of the drum is referred to as a horizontal (X) direction (sub scanning direction), and the circumferential direction of the drum is referred to as a height (Y) direction (main scanning direction). In terms of pixels, this recording image size corresponds to 400 dots in the horizontal direction and 500 dots in the height direction.

The size of the original raster image storing region P is at least as large as the recording image size (i.e., not the size of the image after being recorded, but the size of image information to be recorded), so as to accommodate image information of 400 dots in the horizontal direction and 500 dots in the height direction. The actual image size is the size of the received rasterized original image data (P). The image size of the rasterized original image data (P) is assumed to have a width of Pw and a height of Ph.

The movable stage 15 is capable of moving a distance longer than the prescribed recording width w. The movable stage 15 is positioned on the left in the axial direction of the drum when recording starts, and moves toward the right as an image is being recorded. In the first embodiment, it is assumed that the image forming apparatus performs step scanning.

(Positional Displacement Information)

Figure 1:
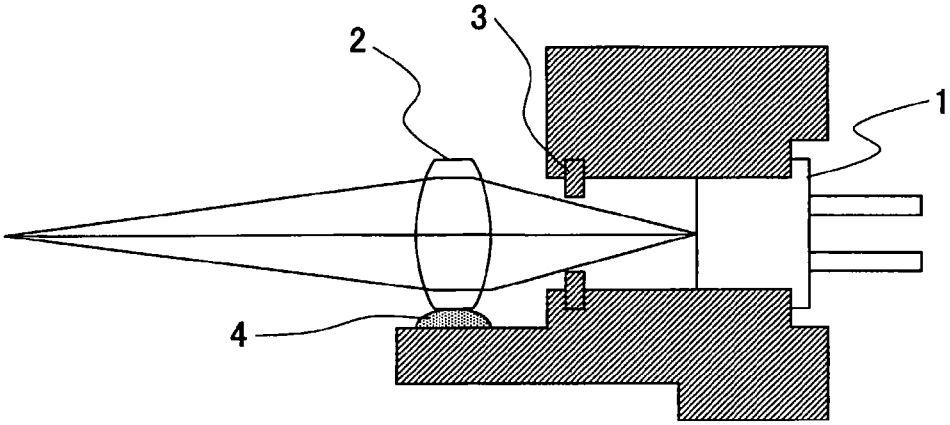
FIG. 1 is a cut-away side view of a recording head.
Figure 2:
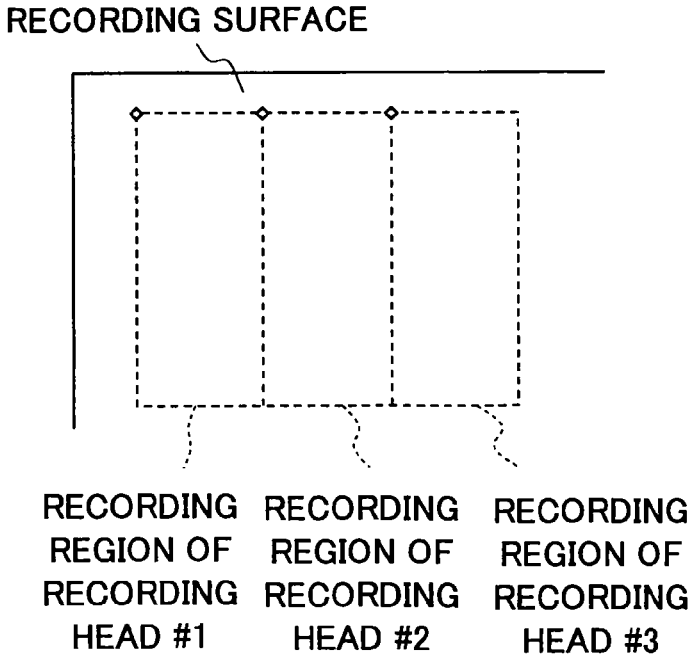
FIG. 2 is an example of images when recording positions of recording heads are at ideal positions.
Figure 3:
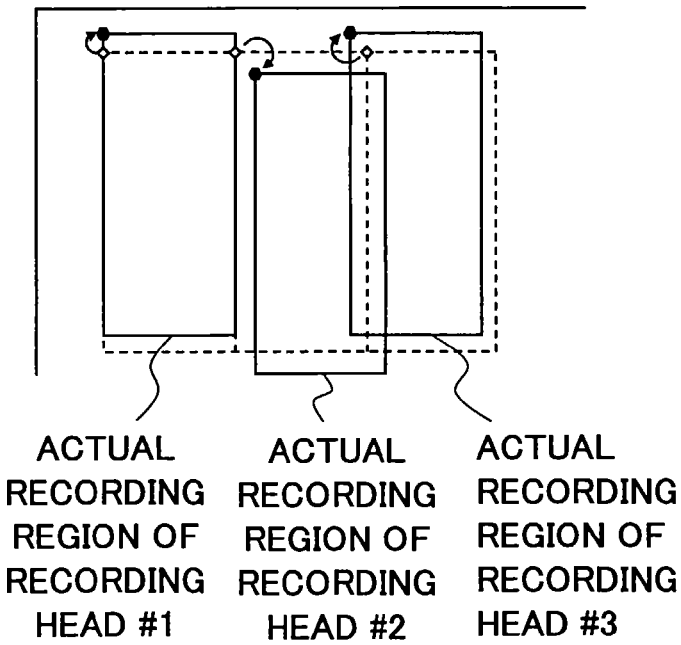
FIG. 3 is an example of images when recording positions of recording heads are at actual positions.
Figure 4:
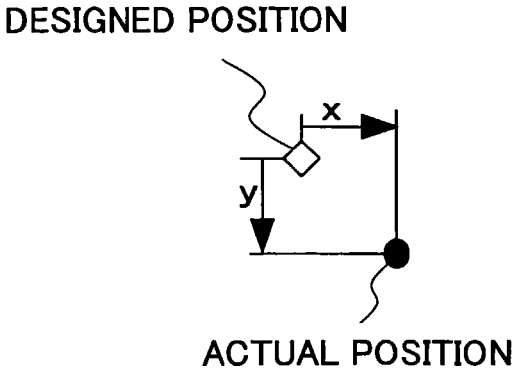
FIG. 4 is a diagram for describing positional displacement.
Figure 5:
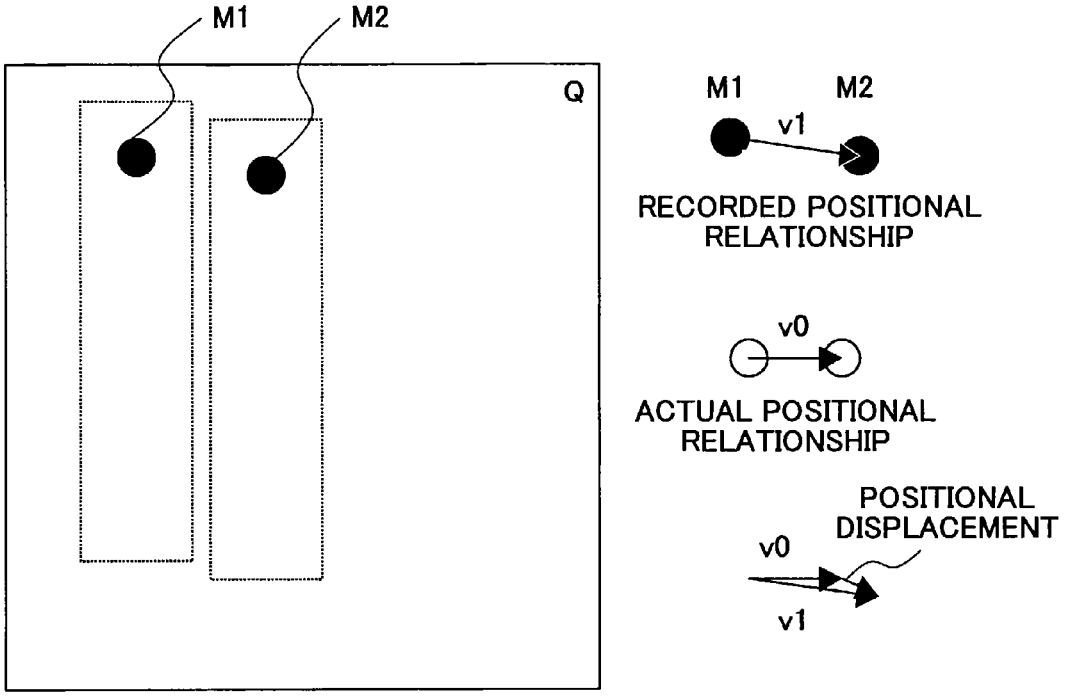
FIG. 5 is another diagram for describing positional displacement.

Next, positional displacement information that is previously loaded in the positional displacement information storing unit 23 is described. In the first embodiment, the positional displacement information represents relative distances between two recording heads, as described with reference to FIG. 5.

For adjacent recording beams such as Rb1 and Rb2, Rb2 and Rb3, Rb3 and Rb4, and so forth, positional displacement information in the X direction is expressed as $\Delta x[1]$, $\Delta x[2]$, $\Delta x[3]$, and positional displacement information in the Y direction is expressed as $\Delta y[1]$, $\Delta y[2]$, $\Delta y[3]$. If $\Delta x[m]$ (m=1, 2, 3, . . . , N−1) is positive, gaps are formed between specified recording images of Rb[m] and Rb[m+1]. If $\Delta x[m]$ (m=1, 2, 3, . . . , N−1) is negative, there is a superposed region between the specified recording images of Rb[m] and Rb[m+1]. If $\Delta y[m]$ is positive, among of the specified recording images of Rb[m] and Rb[m+1], the image of Rb[m+1] is displaced downward.

For $\Delta x[m]$ (m=1, 2, 3, . . . , N−1), $\Delta y[m]$ (m=1, 2, 3, . . . , N−1), maximum permissible values $\Delta x1$, $\Delta y1$ are specified. Accordingly, $-\Delta x1 \leqq \Delta x[m] \leqq \Delta x1$ (m=1, 2, 3, . . . , N−1), $-\Delta y1 \leqq \Delta y[m] \leqq \Delta y1$ (m=1, 2, 3, . . . , N−1) are satisfied. The maximum permissible values are previously determined in consideration of assembly precision of the machine and distribution of assembly positions. In the first embodiment, the following positional displacement information is assumed.

$\Delta x[1]=2.3$ mm, $\Delta x[2]=-1.0$ mm, $\Delta x[3]=0.5$ mm $\Delta y[1]=1.1$ mm, $\Delta y[2]=-3.2$ mm, $\Delta y[3]=0.0$ mm The value of $\Delta xmax$, which is the maximum $\Delta x$, is extracted. In the first embodiment, $\Delta xmax=\Delta x[1]=2.3$ mm.

Further, $\Delta y$ is a relative value with the adjacent region, so that addition is sequentially performed from $\Delta y[1]$, to be converted into a height yn with Rb1 as the reference. This is obtained as $yn[1]=0$, $yn[2]=\Delta y[1]$, $yn[3]=\Delta y[1]+\Delta y[2]$, $yn[4]=\Delta y[1]+\Delta y[2]+\Delta y[3]$.

In the first embodiment, $yn[1]=0$ mm, $yn[2]=1.1$ mm, $yn[3]=-2.1$ mm, $yn[4]=-2.1$ mm.

Next, $\Delta ynmax$, which is the maximum value of $\Delta yn$, and $\Delta ynmin$, which is the minimum value of $\Delta yn$, are extracted. Accordingly, $\Delta ynmax=\Delta yn[2]=1.1$ mm, $\Delta ynmin=\Delta yn[3]=-2.1$ mm.

A permissible range is specified also for yn, as $-yn1 \leqq yn \leqq +yn1$.

(Generation of Width Qw of Image Data (Q))

Image data (Q) are stored in the recording image storing region Q, based on positional displacement information and rasterized original image data (P). The image size of the image data (Q) has a width Qw and a height Qh.

A description is given on how the width Qw and the height Qh of the image data (Q) are determined based on positional displacement information and rasterized original image data (P).

Figure 12:
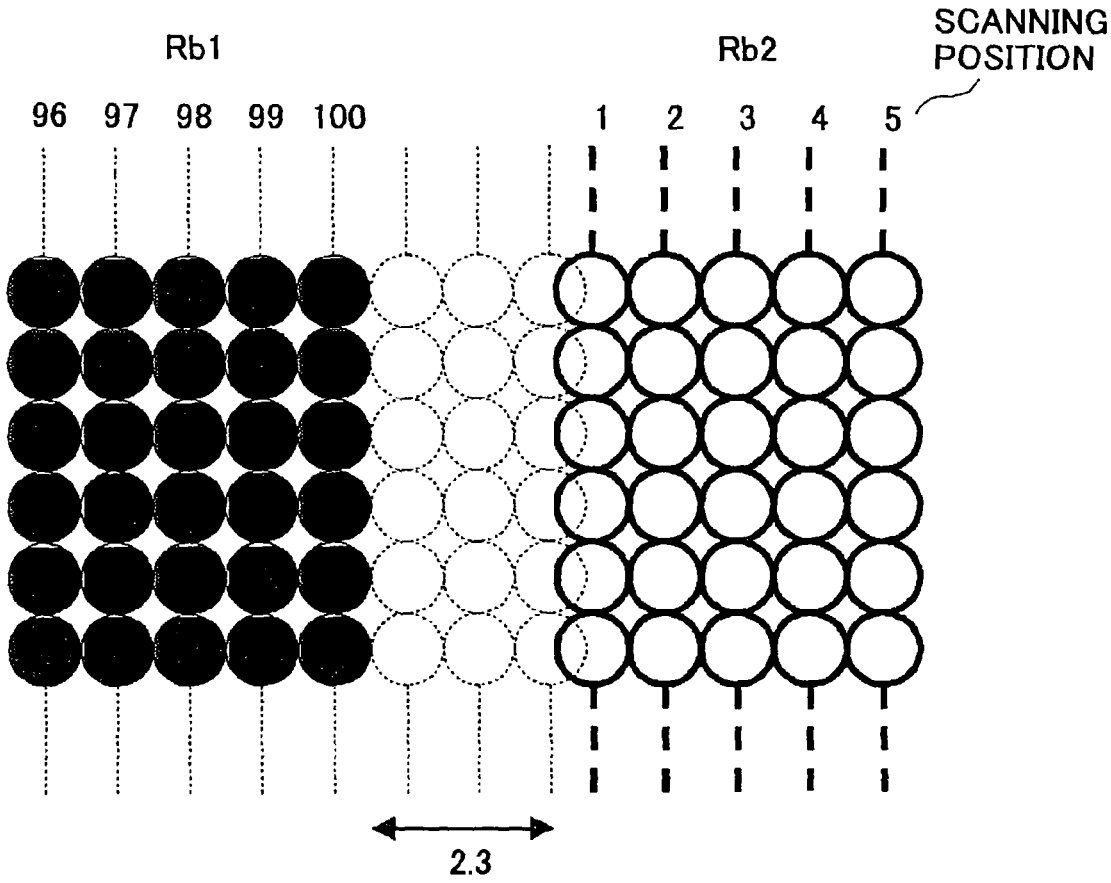
FIG. 12 is an explanatory diagram of a gap between recording beams from adjacent recording heads.

The prescribed recording width w and $\Delta xmax$ are added together to obtain $w+\Delta xmax=102.3$ mm. This expresses a distance between beams where adjacent recording beams are furthest apart. This result is multiplied by the prescribed image recording density p to obtain the number of scanning lines, as $(w+\Delta xmax)\times p=102.3$ lines. In this case, $\Delta xmax$ is a positional displacement between Rb1 and Rb2, which means that there is a gap of 2.3 dots between the recording images of Rb1 and Rb2. The prescribed recording width w is 100 lines; therefore, a gap of 2.3 dots is formed as shown in FIG. 12. This gap can be filled or reduced by increasing the prescribed recording width w. By increasing the prescribed recording width w to 102 dots, the gap becomes 0.3 dots.

In the first embodiment, in order to prevent any gaps, a fractional dot is rounded up to an integral dot.

Figure 13:
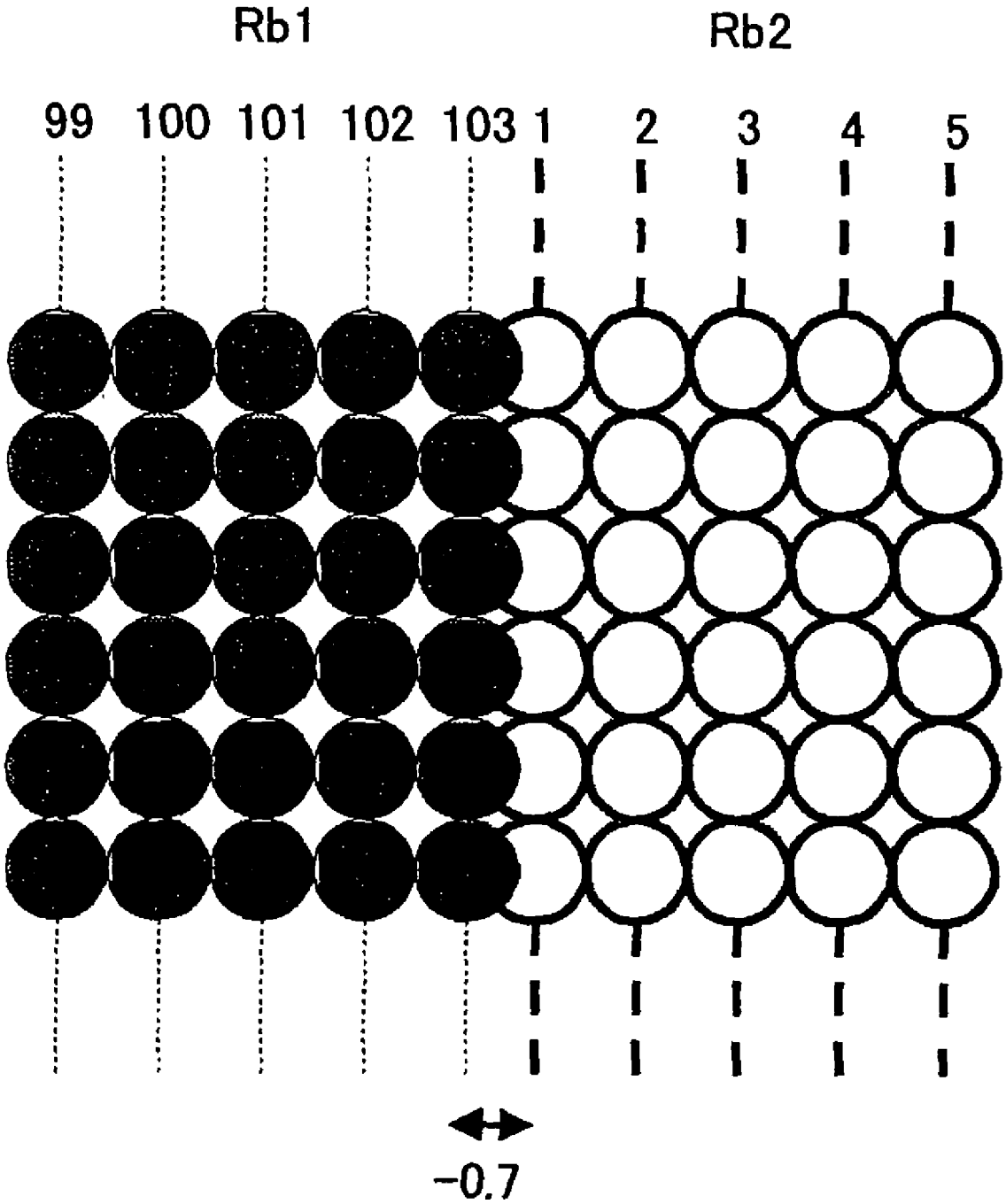
FIG. 13 is an explanatory diagram of partially superposed recording beams from adjacent recording heads.

Thus, when the gap is 2.3 dots, Rb1 and Rb2 are made to superpose each other by 0.7 dots, as shown in FIG. 13.

The prescribed recording width w is obtained from the maximum positional displacement $\Delta xmax$. Therefore, by specifying the prescribed recording width w to be 103 dots for all recording heads, gaps can be prevented from appearing between recording images of recording beams.

If $\Delta xmax$ is negative, e.g., −2.7 mm, the same process is performed. A negative $\Delta xmax$ indicates that there is a superposed part between the recording images. In this example, $w+\Delta xmax=97.3$ mm. The prescribed recording width w becomes 98 dots, so that the superposed part is 0.7 dots.

(Specification of Fine Control Area QF)

Figure 14:
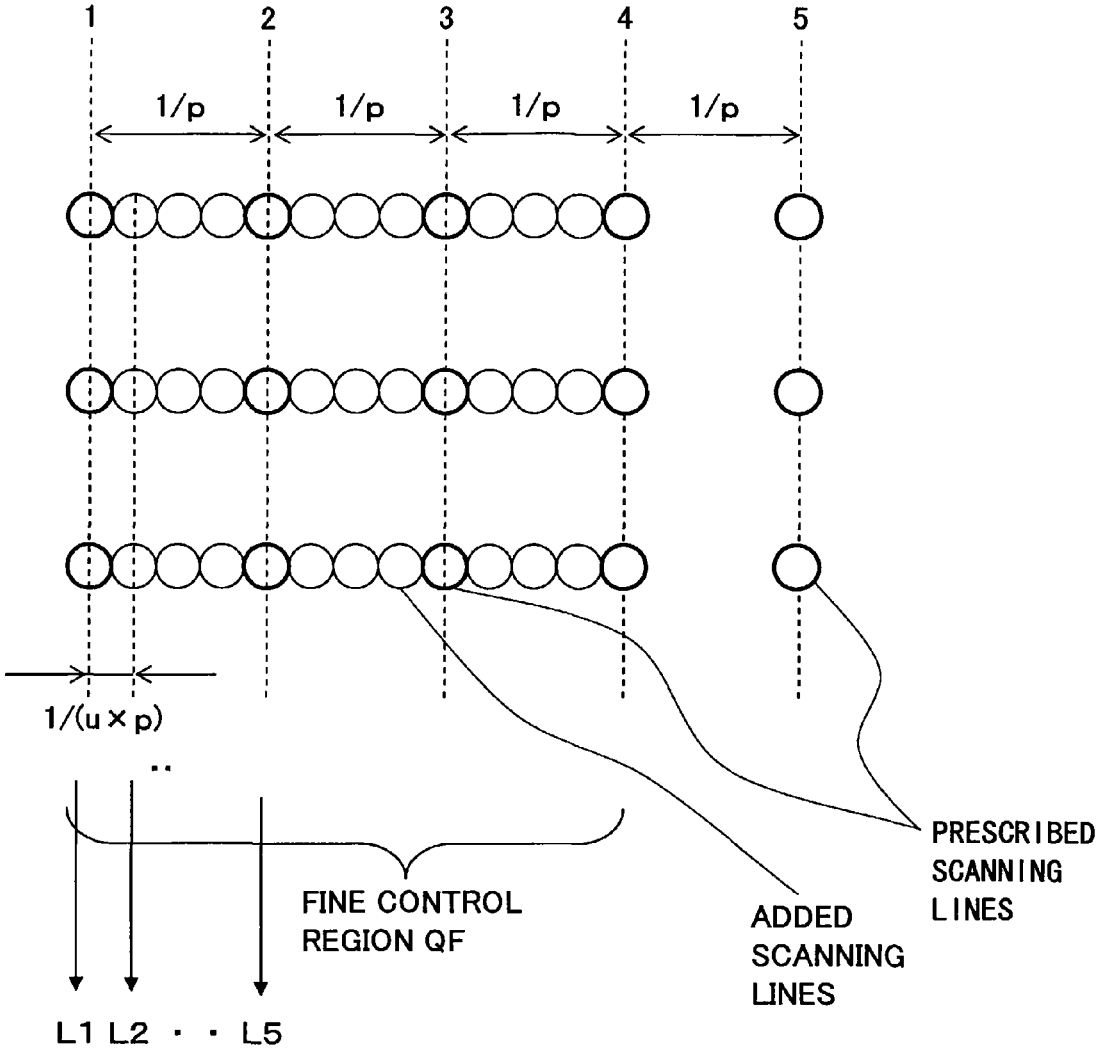
FIG. 14 is a schematic diagram of a fine control area QF.

Next, superposed parts corresponding to fractional dots are taken into consideration. When the recording image Rb1 and the recording image Rb2 superpose each other by a fractional dot smaller than an integral dot, it is necessary to move the image recording position of Rb2. However, all of the recording heads simultaneously move on a single movable stage; therefore, in order to only move Rb2, another moving means would be required. Accordingly, a fine control area QF is formed, in which the image recording density is increased. For example, as shown in FIG. 14, in a recording region of a recording beam, the image recording density is quadrupled in the X direction for the first four lines. A recording density multiplying factor used for increasing the image recording density is expressed as $u(u \geqq 1)$. Accordingly, it is possible to create image data in units of 1/u dots. When the density is quadrupled, three scanning lines (e.g., L2, L3, L4: dots indicated by circles of thin lines are scanned from the top circle to the bottom circle) are added in between the prescribed scanning lines (e.g., L1, L5: dots indicated by circles of thick lines are scanned from the top circle to the bottom circle). The added scans 3×3 are referred to as "additional scanning". Accordingly, in the fine control area QF, nine scanning lines are added, as obtained from (u−1)×(u−1)=3 lines×3=9 lines.

The horizontal width of an image size allocated to each recording head is obtained by adding the prescribed recording width w with the fine control area QF, as 103+9=112 dots, which is hereinafter referred to as base width Nw.

$$Nw=w+D\{\Delta xmax\}+(u-1)\times(u-1)$$

The operation of rounding up a value "a" to an integer is expressed as D{a}.

As shown in FIG. 11, the entire width Qw of the recording image storing region Q corresponds to N recording heads arranged horizontally, where each recording head has a base width Nw. Thus, the entire width Qw of the recording image storing region Q is expressed by the following equation:

$$Qw=Nw\times N$$

(Generating height Qh of image data (Q))

Next, the height Qh of the image of the recording image storing region Q is expressed by the following equation:

$$Qh=Ph+D\{\Delta ynmax-\Delta ynmin\}$$

In this example, when Ph is 500 dots, the height of the image is 504 dots. The height can constantly be a maximum height, as expressed by Qh=Ph+D{2×Δyn1}.

The above describes one example of a method for determining the width Qw and the height Qh of the recording image storing region Q. The width Qw and the height Qh correspond to the image data size, and not the actual width and height of the image recorded on the recording body. If image data are recorded by scanning at high density, the recorded image becomes compressed.

(Scanning Information)

Scanning information is created in association with row data in the height direction of the image data (Q).

Scanning information includes the order in which rows in the height direction of an image are scanned and the scanning positions thereof.

The scanning information is obtained by $$L[k]=1/u\times(k-1)+1\ (k=1, 2, \ldots, u\times(a-1))$$

$$L[k]=k-u\times(a-1)+a-1\ (k=u\times(a-1)+1, u\times(a-1)+2, \ldots, Nw)$$

based on the recording density multiplying factor u, the prescribed image recording density p, the positional displacement information, the prescribed recording width w, and the base width Nw. Scanning for the fine control area QF is performed for a length of "a" scans in the prescribed image recording density p.

Figure 15:
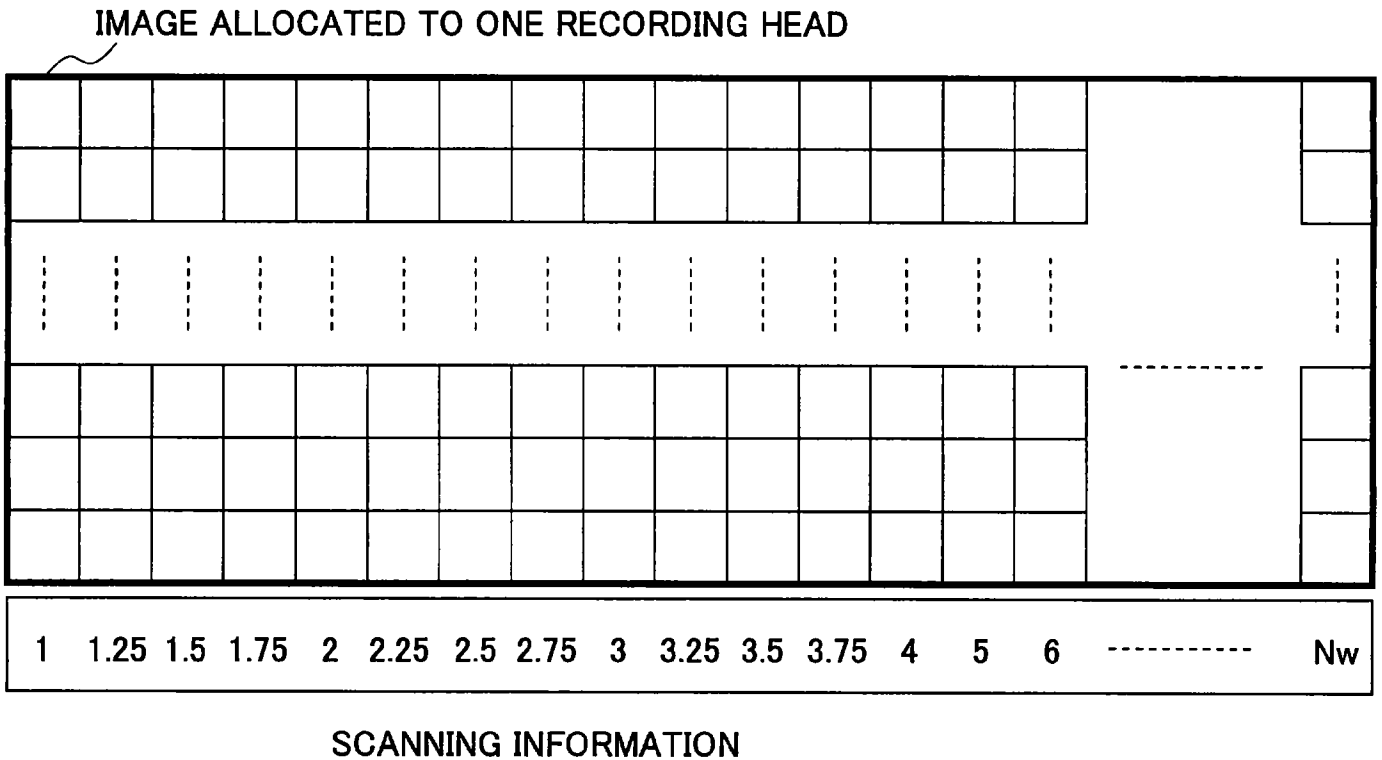
FIG. 15 is a schematic diagram of scanning information.

In the first embodiment, it is assumed as a=u=4. As shown in FIG. 15, the scanning position of the far left row is L[1]=1, the second row is L[2]=1.25, the third row is L[3]=1.5, and so forth. The scanning positions are in units of one scan in the prescribed image recording density p, and scanning positions increased in the fine control area QF are in fractional numbers.

For rasterized original image data (P) of 400×500 dots, a recording image region having a width of 448 dots and a height of 504 dots is provided as an image data (Q). These image data are loaded in the recording image storing region Q of the image data (Q) storing unit 25. The scanning information includes the order of scanning, and therefore, the scanning information is the same for all four recording heads. The same scanning information is repeatedly associated with the arranged image data. Accordingly, the scanning information indicates positions of scanning operations for the rows in the height direction of the image data (Q).

In the case of step scanning, the scanning information includes scanning positions and the scanning order for data in the main scanning direction of the image data (Q) to be recorded. In the image data (Q), the first recording in the main scanning direction is performed at a scanning position L[1]. When the first main scanning data set of the image data (Q) is loaded in the buffer, the stage control unit 30 reads the scanning information L[1], and moves the movable stage to the position indicated by L[1]. When the stage control unit 30 finishes moving the movable stage to the position indicated by L[1], the driving control units 31 receive the rotational position of the drum from the drum driving control unit 29, and turn on/off the recording heads based on buffer data at predetermined drum positions in synchronization with the drum rotation. When scanning is completed for one main scanning line, the second main scanning data set of the image data (Q) is loaded in the buffer, and the same process is performed based on scanning information L[2]. The same process is repeated for subsequent sets of scanning information, until scanning is completed for the scanning information of the last position. This is an example of step scanning.

In the case of spiral scanning, the stage control unit 30 reads scanning information L[1]. When the present scanning position has not reached the position of L[1], the stage control unit 30 continues to move the moving stage. When the present scanning position has passed the position of L[1], the stage control unit 30 moves the moving stage backward (return from overwriting). Under normal circumstances, the stage control unit 30 continues to move the moving stage forward. The stage control unit 30 sequentially transfers the present stage position to the driving control units 31. The drum driving control unit 29 sequentially transfers the drum rotational position to the driving control units 31. When the driving control units 31 detect that the stage position has reached the position of L[1], the driving control units 31 turn on/off the recording heads based on buffer data in synchronization with the drum rotation. When buffer data for one main scanning operation are recorded, the same process is performed based on the next scanning information L[2]. The same process is repeated until scanning is completed for the scanning information of the last position.

When the present scanning position has passed the position of the scanning information, the stage control unit 30 moves the movable stage backward to a reference position, such as the home position. In order to perform scanning at the position specified by the scanning information, the stage control unit 30 controls the speed of the movable stage in synchronization with the drum rotational position received from the drum driving control unit 29, and moves the movable stage at a predetermined constant speed.

(Generation of Image Data (Q))

Image data are changed and transferred from the original raster image storing region P of the rasterized original image data (P) storing unit 22 to the recording image storing region Q of the image data (Q) storing unit 25.

This operation is described next.

A data value for not performing image recording is initially specified for the image in the recording image storing region Q. An image width Rpw allocated to each recording head is determined based on the prescribed recording width w and Δx(m=1, 2, 3, . . . , N−1), by $$Rpw[m]=D\{w+\Delta x[m]\}(m=1, 2, \ldots, N-1).$$

In the first embodiment, as described above, it is assumed as follows:

$$\Delta x[1]=2.3\text{ mm}, \Delta x[2]=-1.0\text{ mm}, \Delta x[3]=0.5\text{ mm}$$

Therefore, in the case of the recording head R[1], there are, Rpw[1]=103 dots. Similarly, for the recording heads R[2] and R[3], there are Rpw[2]=99 dots and Rpw[3]=101 dots. For the last, fourth recording head R[4], the maximum positional displacement width Δxmax is used, so that there are Rpw[4]=103 dots.

Figure 16:
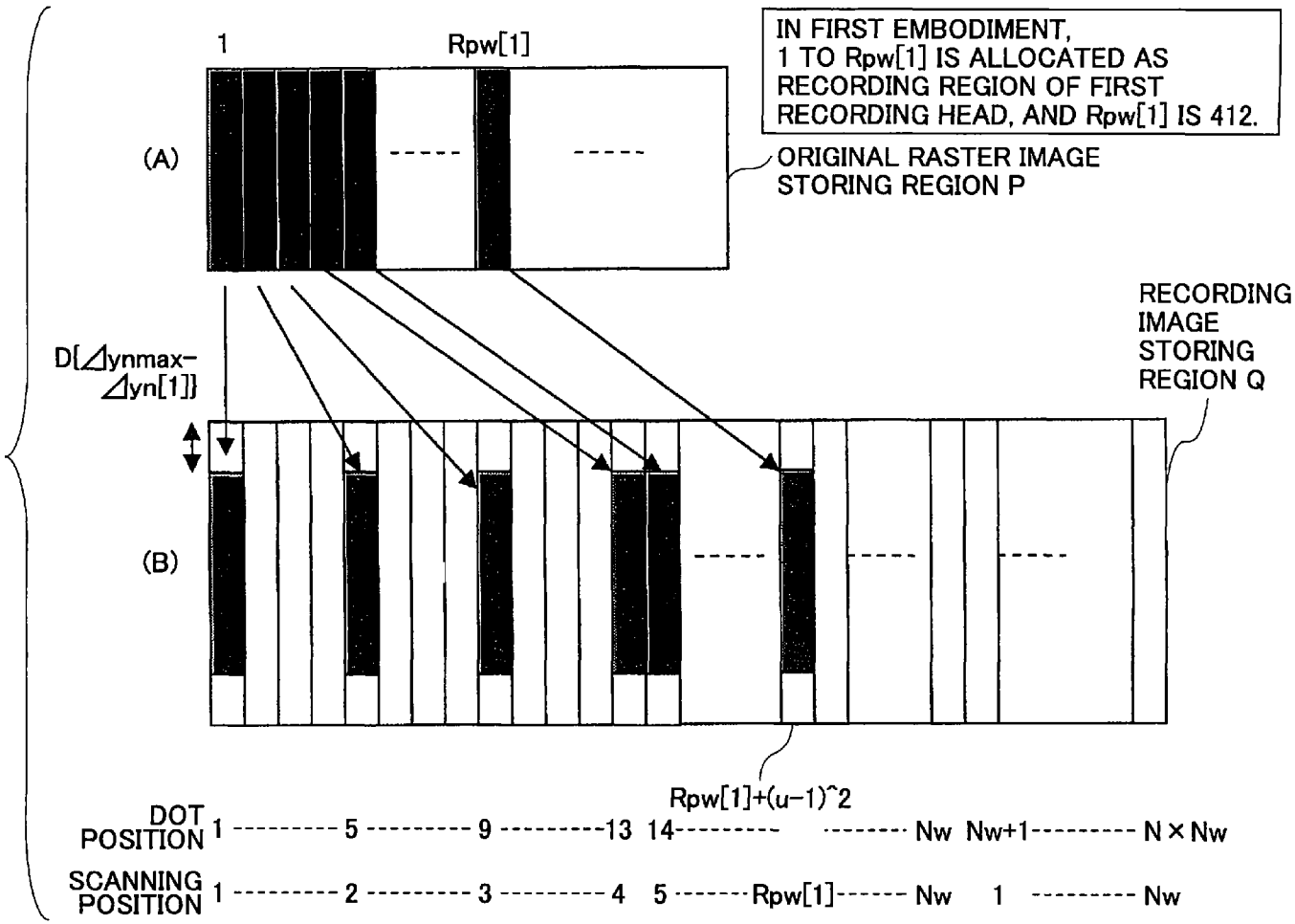
FIG. 16 is an explanatory diagram of image data (Q)

As indicated by (A), in FIG. 16, the first dot from the left through the dot at Rpw[1], in the image of the original raster image storing region P are allocated to the recording head R[1]. The dot at Rpw[1]+1 through the dot at Rpw[1]+Rpw[2] are allocated to the recording head R[2]. The dot at Rpw[1]+Rpw[2]+1 through the dot at Rpw[1]+Rpw[2]+Rpw[3] are allocated to the recording head R[3]. The dot at Rpw[1]+Rpw[2]+Rpw[3]+1 through the dot at Rpw[1]+Rpw[2]+Rpw[3]+Rpw[4] are allocated to the recording head R[4].

(Positional Adjustment in Height Direction)

At the same time, positional adjustments are made in the height direction according to yn.

The original raster image storing region P is indicated by (A) in FIG. 16, and the recording image storing region Q is indicated by (B) in FIG. 16. Data in the height direction of the first dot from the left of the image in the original raster image storing region P, which is within the range allocated to the recording head R[1], are transferred to the first dot from the left in the recording image storing region Q, to be positioned starting from the dot at D{Δynmax−Δyn[m]+1) counted from the top. Data in the height direction of the second dot from the left in P are transferred to the fifth dot from the left in Q, to be positioned starting from the dot at D{Δynmax−Δyn[1]+1) counted from the top. In the range allocated to the recording head R[1], fine control is not performed; therefore, data of P are not transferred to a row in Q where the scanning information indicates a fractional number. The rest of the data are transferred from P to Q in the same manner, and last, data in the height direction of the dot at Rpw[1] from the left in P are transferred to the dot at Rpw[1]+9 from the left in Q, to be positioned starting from the dot at D{Δynmax−Δyn[1]+1) counted from the top.

(Adjustment in Fine Control Area QF)

When there is a superposing region between the recording head R[1] and the adjacent recording head R[2], the fine control areas QF are usually superposed.

Figure 17A:
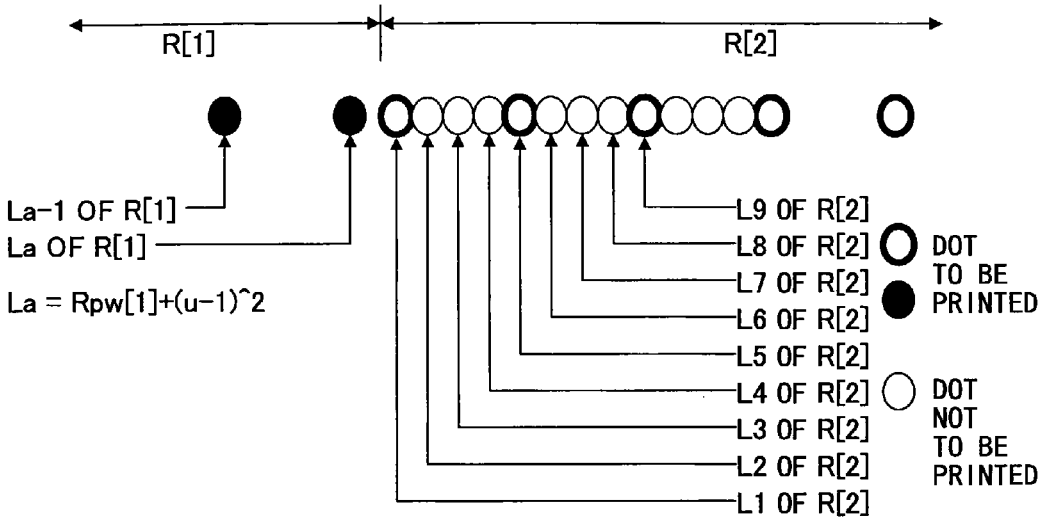
FIGS. 17A, 17B are explanatory diagrams of adjustments in a fine control area QF.

Unless adjustments are made in the fine control areas QF, as shown in FIG. 17A, the bit scanned last by the recording head R[1] and the bit scanned first by the recording head R[2] are too close to each other; this causes stripes to appear at the boundary.

Figure 17B:
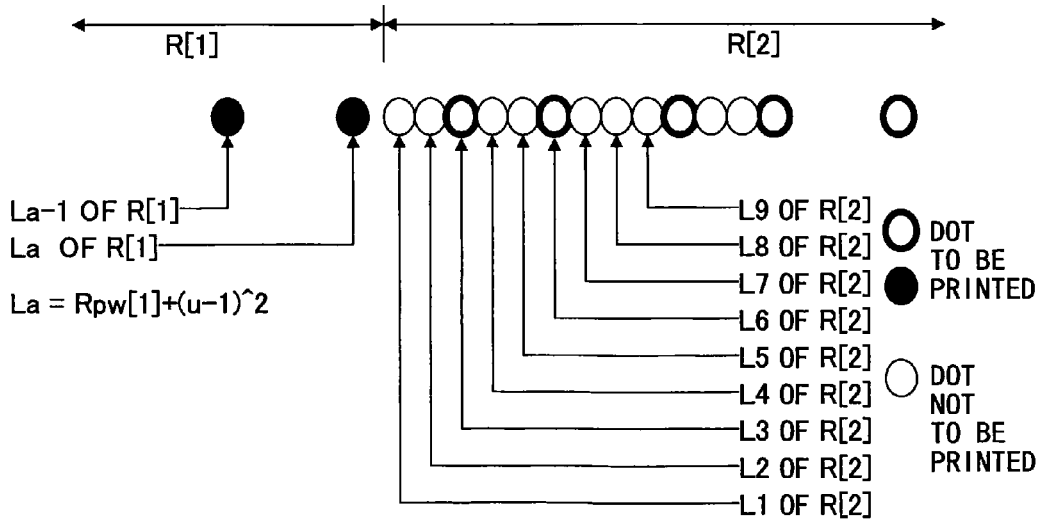

In order to solve this problem, as shown in FIG. 17B, adjustments are made in the adjustment region of the recording head R[2], so that there are substantially equal intervals between scanning lines.

A general description is made of the operation performed by the recording head R[m](m=2, 3, . . . , N) in the allocated range. The data in the height direction are transferred to be positioned starting from the dot at D{Δynmax−Δyn[m]+1) counted from the top. In the horizontal direction, fractional numbers in the positional displacement information are noted, so as to consider the fine control areas QF. A fractional number ΔxR in the region allocated to each recording head is obtained as follows:

$$\Delta xR[m]=1-Rpw[m-1]+(w+\Delta x[m-1])\times p$$

The unit is in dots.

Figure 18:
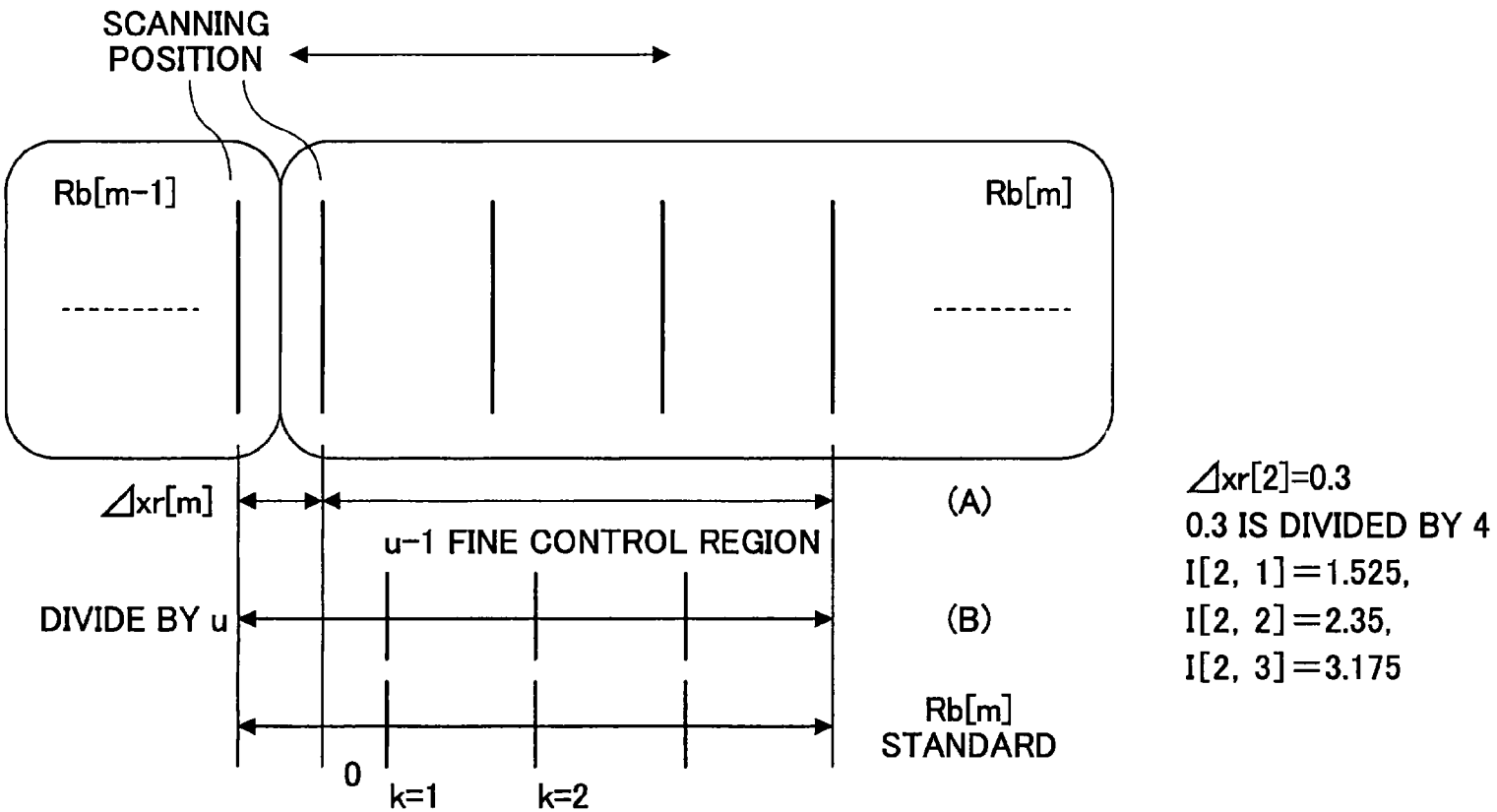
FIG. 18 is another explanatory diagram of adjustments in a fine control area QF.

In the first embodiment, when m=2, then ΔxR[m]=0.3 is satisfied. This means that scanning intervals between scanning performed by recording heads Rb[m−1] and Rb[m] correspond to 0.3 dot by the prescribed image recording density p, as shown in FIG. 18. In order to correct this fractional number in the fine control area QF, a width (u−1)+ΔxR[m] including the fine control area QF is considered. This range is adjusted with u−1 scanning lines, and therefore, the images are preferably recorded with intervals of ((u−1)+ΔxR[m])/u. Accordingly, the scanning position 1[m,k] of the kth line (k=1, 2, . . . , u−1) scanned by Rb[m] is to be $$1[m,k]=(((u-1)+\Delta xR[m])/u)\times k-\Delta xR[m]+1.$$

Figure 19:
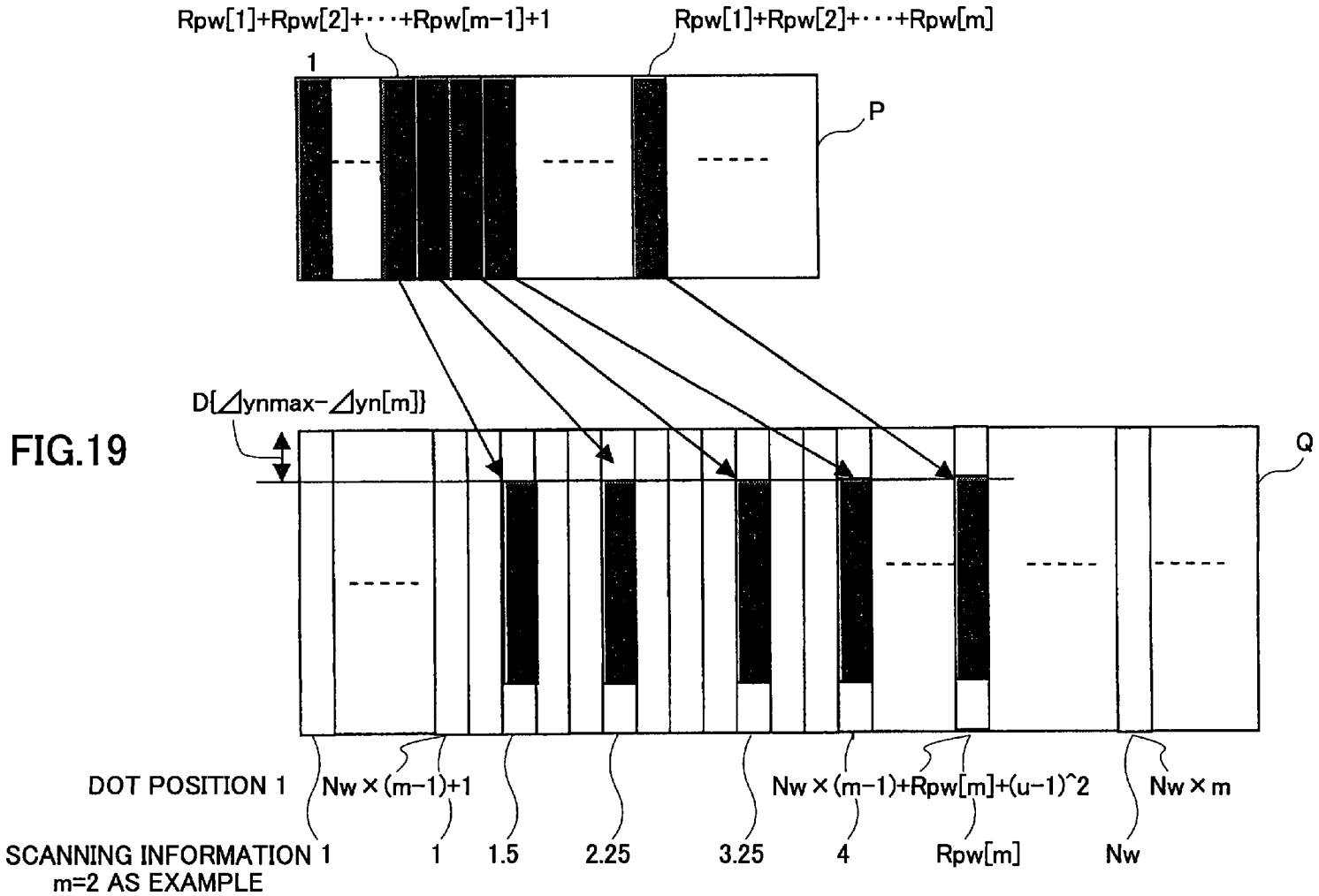
FIG. 19 is yet another explanatory diagram of adjustments in a fine control area QF.

Specifically, 0.3 dot is divided into four, and added into scanning intervals of the fine control area QF. As a result, as shown in FIG. 19, the following are obtained in the first embodiment:

$$1[2,1]=1.525,\ 1[2,2]=2.35,\ 1[2,3]=3.175$$

Image data are changed and transferred from the original raster image storing region P of the rasterized original image data (P) storing unit 22 to the recording image storing region Q of the image data (Q) storing unit 25, at a position where the scanning position 1 and scanning information L are closest. The above describes the case of m=2; the same process is performed beyond m=2.

When all of the rasterized original image data (P) in the original raster image storing region P are transferred, and there is not enough data to be transferred to fill the recording image storing region Q, data indicating that the recording head does not irradiate a recording beam are also transferred.

Supposing that there are N recording heads, the width that can be recorded by the N recording heads is not necessarily equal to the width of the rasterized original image data (P). If the width of the rasterized original image data (P) is narrower, there would be recording heads that do not record data within the rasterized original image data (P). In this case, the rasterized original image data (P) is not necessarily divided by N. For example, the width of the rasterized original image data (P) is divided by the width allocated to each recording head, and fractions are rounded up to integers, thereby obtaining the number by which the rasterized original image data (P) is divided.

Figure 20:
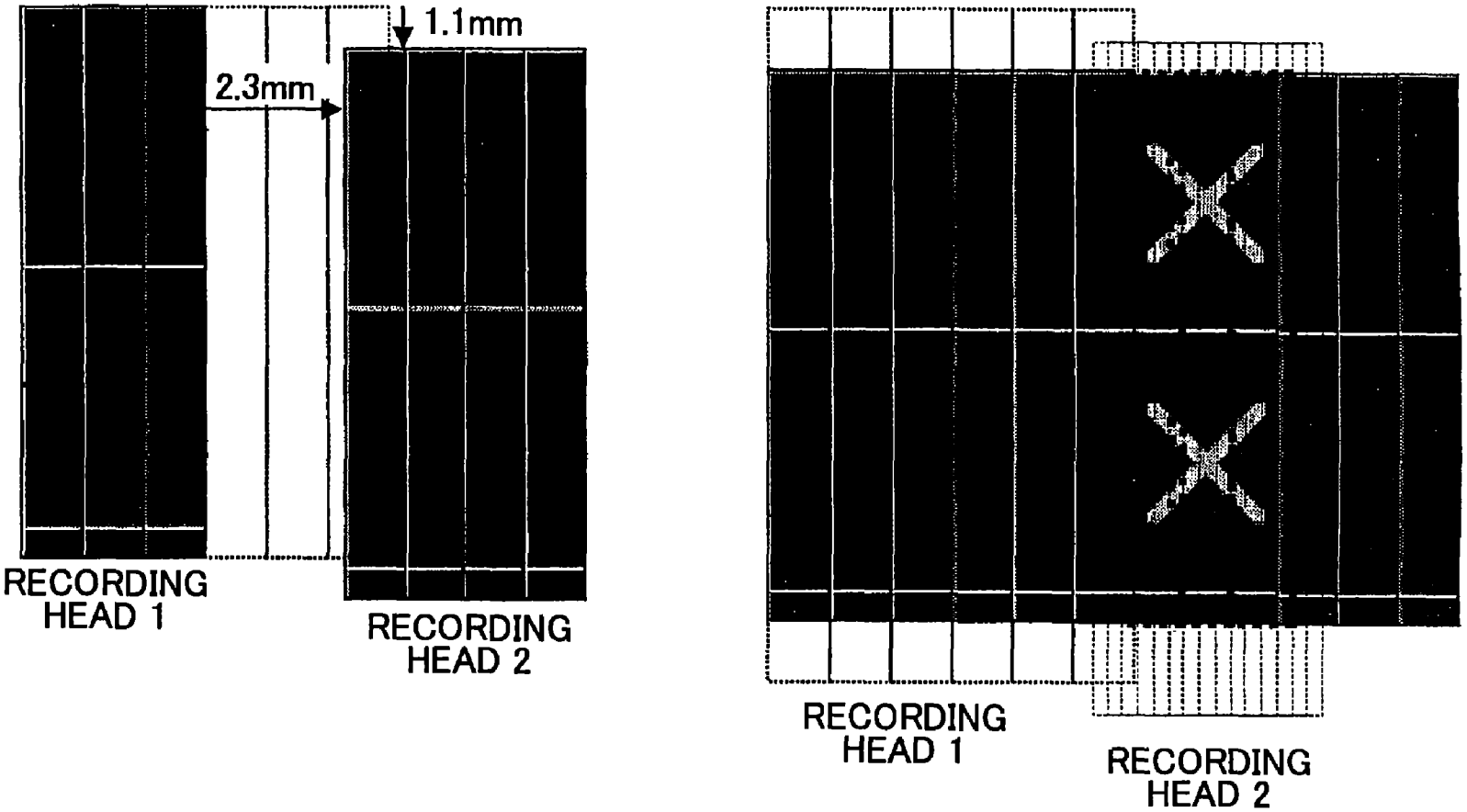
FIG. 20 is a schematic diagram of recording positions also corrected in a width direction.

By transferring the recording image data from the original raster image storing region P to the recording image storing region Q as described above, the image data (Q) generated are displaced heightwise toward a direction opposite to the positional displacement information. Accordingly, the heightwise positional displacement is offset, so that the heights of the recording images are aligned. The recording positions in the width direction are also corrected, as shown in FIG. 20. A fractional dot smaller than an integral dot remains in the height direction; therefore, the fractional dot is added as Lh to the scanning information to each row in the height direction.

The driving control units 31 shown in FIG. 10 change driving timings based on the height information Lh of the scanning information. By changing the driving timings, the heightwise position of an image formed on the recording body can be changed by a fractional dot smaller than an integral dot. For example, the recording timing signals are adjusted to be in a cycle that is 16 times higher than a cycle necessary for the actual prescribed image recording density p. Accordingly, the scanning start position can be changed in units of 1/16 dots. By making this change based on the scanning information Lh, it is possible to offset errors by fractional dots in the height direction of the recording image.

Figure 21:
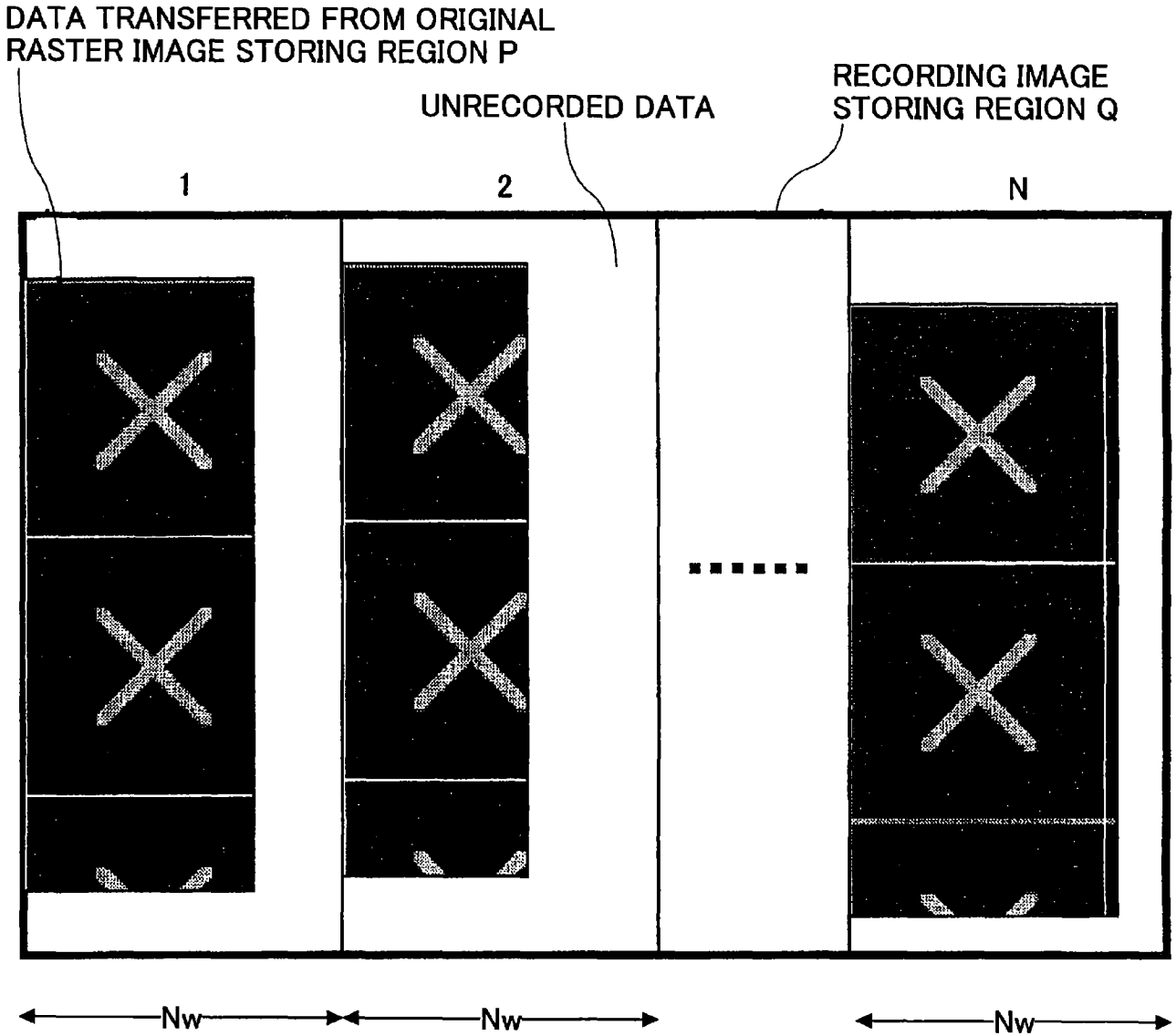
FIG. 21 is a schematic diagram of image data (Q)

The image data (Q) of the recording image storing region Q are thus created. FIG. 21 is a schematic diagram of the created image data (Q).

The above describes one example of a data position changing unit. The recording head records an image based on the image data in the recording image storing region Q thus created, and the scanning information.

The pixels of the image are recorded in the above-described scanning order shown in FIG. 11. N recording heads simultaneously record N pixels. The height direction of the image corresponds to main scanning in the rotational direction of the drum, and the horizontal direction corresponds to sub scanning in the axial direction of the drum.

(Process of Image Formation)

Figure 22:
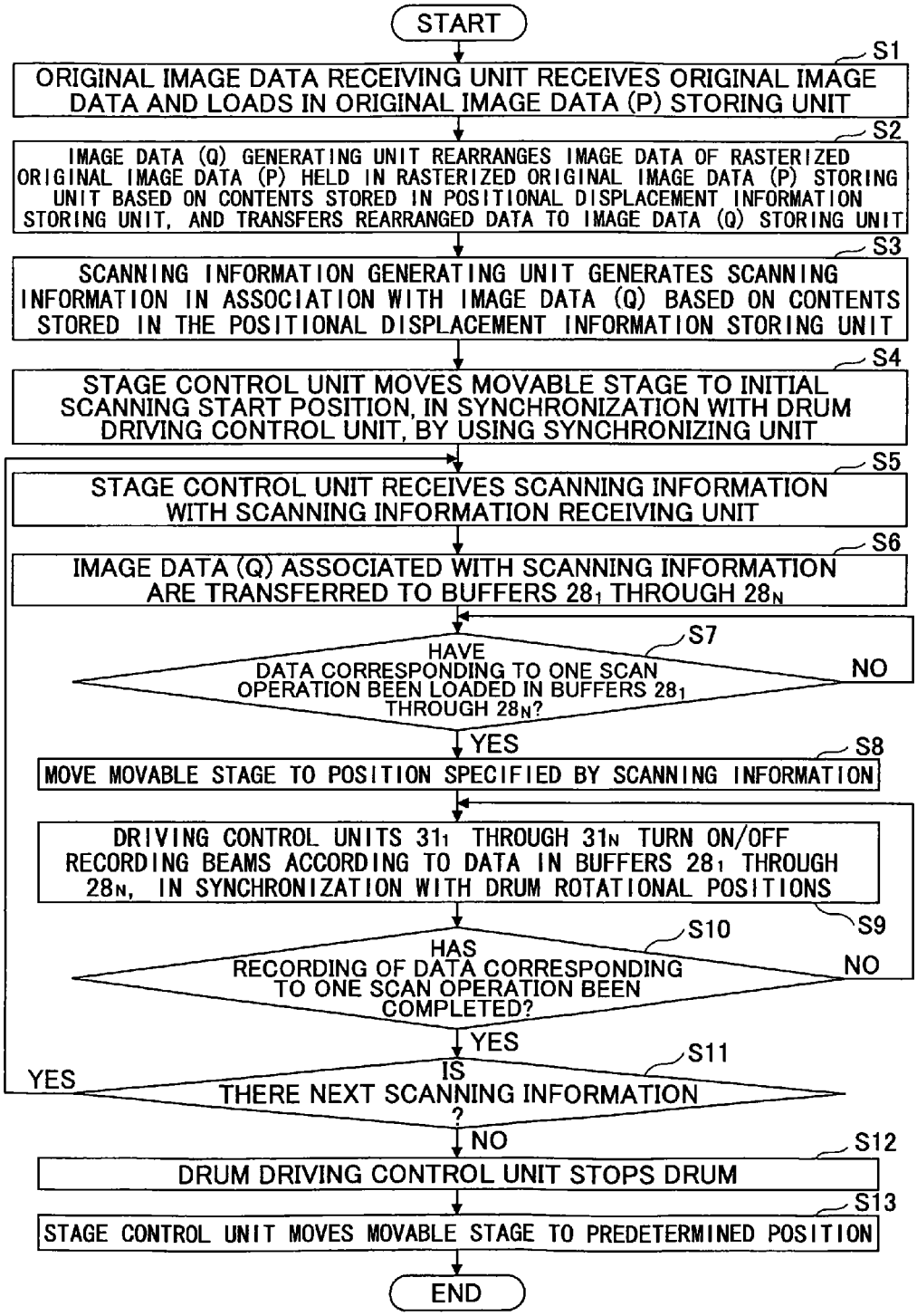
FIG. 22 is a flowchart of an image forming process.

An image forming process according to the first embodiment is described with reference to FIG. 22.

Step S1: The original image data receiving unit 21 receives rasterized original image data (P), and loads it in the rasterized original image data (P) storing unit 22.

Step S2: The image data (Q) generating unit 24 rearranges the image data of the rasterized original image data (P) held in the rasterized original image data (P) storing unit 22 based on contents stored in the positional displacement information storing unit 23, and transfers the rearranged data to the image data (Q) storing unit 25.

Step S3: The scanning information generating unit 26 generates scanning information in association with the image data (Q) based on contents stored in the positional displacement information storing unit 23.

Step S4: The stage control unit 30 moves the movable stage to an initial scanning start position, in synchronization with the drum driving control unit 29 by using a synchronizing unit.

Step S5: The stage control unit 30 receives scanning information with a scanning information receiving unit.

Step S6: Image data (Q) associated with scanning information are transferred to the buffers $\mathbf{28}_1$ through $\mathbf{28}_N$.

Step S7: Wait for data corresponding to one scan operation to be loaded in the buffers $\mathbf{28}_1$ through $\mathbf{28}_N$.

Step S8: Move the movable stage to a position specified by the scanning information.

Step S9: The driving control units 31, through $\mathbf{31}_N$ turn on/off the recording beams according to data in the buffers $\mathbf{28}_1$ through $\mathbf{28}_N$, in synchronization with the drum rotational positions.

Step S10: Determine whether recording of data corresponding to one scan operation is completed.

Step S11: Determine whether there is next scanning information. When there is, steps S5 through S9 are repeated for the next scanning information.

Steps S12, 13: When it is determined that there is no more scanning information in Step S11, the drum driving control unit 29 stops the drum, the stage control unit 30 moves the movable stage to a predetermined position, and the process ends.

When positional displacement information is not changed frequently, the scanning information is the same every time; in this case, it is possible to use scanning information that is obtained and stored in advance, instead of determining the scanning information every time.

The driving control units $\mathbf{31}_1$ through $\mathbf{31}_N$, the drum driving control unit 29, and the stage control unit 30 only need to consider the synchronization of image data with scanning information for one main scanning operation, regardless of the size of the image data (Q) or scanning information.

The same amount of image data is sent to all of the recording heads, and therefore, all of the control devices for the recording heads can be mounted based on the same design. The recording heads are turned on/off based on only image data, and therefore, the devices have simple structures.

The stage is controlled based on scanning information, and image data are associated with the scanning information. Therefore, even if the prescribed image recording density p is partly changed, the driving control units 31 are unaffected. Specifically, it is easy to design the generating unit of the image data (Q) separately from the driving units of the recording heads. It is also possible to perform design verification and operational verification for the generating units for the image data (Q) and the scanning information, separately from that for hardware such as driving control units. Accordingly, development costs can be reduced.

This process can be programmed to be executed by a computer.

(Variations)

In the first embodiment, an image larger than the original raster image is provided in the recording image storing region Q. However, it is also possible to only provide image data corresponding to one scanning operation for each recording head. When performing the scanning operation for recording images, only images necessary for the corresponding scanning positions can be sequentially created and sent to the buffers $\mathbf{28}_1$ through $\mathbf{28}_N$.

In the first embodiment, the fine control area QF is provided on the left side of the image; however, this can also be provided on the right side. In the first embodiment, each original raster image is positioned to be aligned with the left side of a region of the image data (Q) allocated to one of the recording heads; however, this can also be aligned with the right side.

In the first embodiment, when there are slight differences in density between left and right recording beams of adjacent regions, and the fine control area QF is provided on the left side, changes in the image pitch and changes in the image density occur simultaneously. Accordingly, differences in the density become visibly apparent. This is because positional adjustments are made with beams on the right side of the adjacent region. By providing the fine control area QF on the right side, the beams of the left side perform positional adjustments, and density changes occur on the right side. Accordingly, changes are gradually made, so that differences in the density are not visible.

The fine control area QF can be provided at both the scanning start position and a position at which the scanning ends (scanning end position).

Second Embodiment

The rasterized original image data (P) and image data (Q) similar to those of the first embodiment can also be used to operate the movable stage for performing spiral scanning. In spiral scanning, the movable stage is constantly moving at a fixed speed while the image is being recorded. Thus, the scanning is performed at a slant angle with respect to the drum surface.

The movable stage is moved at a speed at which one scanning line is scanned during one rotation of the drum. Assuming that the prescribed image recording density is p and the drum rotation speed is dv, a moving speed xv of the movable stage can be determined by the following equation:

$$xv=(dv/60)\times(1/p)$$

When p=1 line/mm, dv=60 revolutions/second, the obtained moving speed is xv=1 mm/second.

The scanning is performed at a slant angle, which angle is formed as one scanning operation is performed during one drum rotation. This does not cause a problem as long as the scanning pitch is sufficiently small with respect to the drum circumference.

Third Embodiment

In order to provide an area with different recording density such as the fine control area QF, it is necessary to change the moving speed xv of the movable stage. However, it is difficult to change the moving speed during a continuous scanning operation. By changing the moving speed xv, the slant scanning angle changes, which causes visible stripes. When the scanning lines are divided in the main scanning direction in an attempt to correct the slant angles and make the stripes not visible, intervals between recorded dots change in the main scanning direction. As a result, stripes different from those before the correction are formed.

Accordingly, in a third embodiment, scanning information is used to rearrange the order of recording image data, so that an image including an area with a different recording density can be scanned without changing the moving speed xv of the movable stage.

The recording density is increased in the fine control area QF. However, it is considered that the fine control area QF includes plural regions having the same scanning intervals with different starting positions being superposed on one another. Accordingly, the recording densities of the regions are equal, so that there is no need to change the speed of the movable stage.

In this example, it is assumed that the scanning information is similar to the first embodiment, as L[1]=1, L[2]=1.25, L[3]=1.5, L[4]=1.75, L[5]=2, L[6]=2.25, L[7]=2.5, L[8]=2.75, L[9]=3, L[10]=3.25, L[11]=3.5, L[12]=3.75, L[13]=4, L[14]=5, L[15]=6, . . . .

Figure 23:
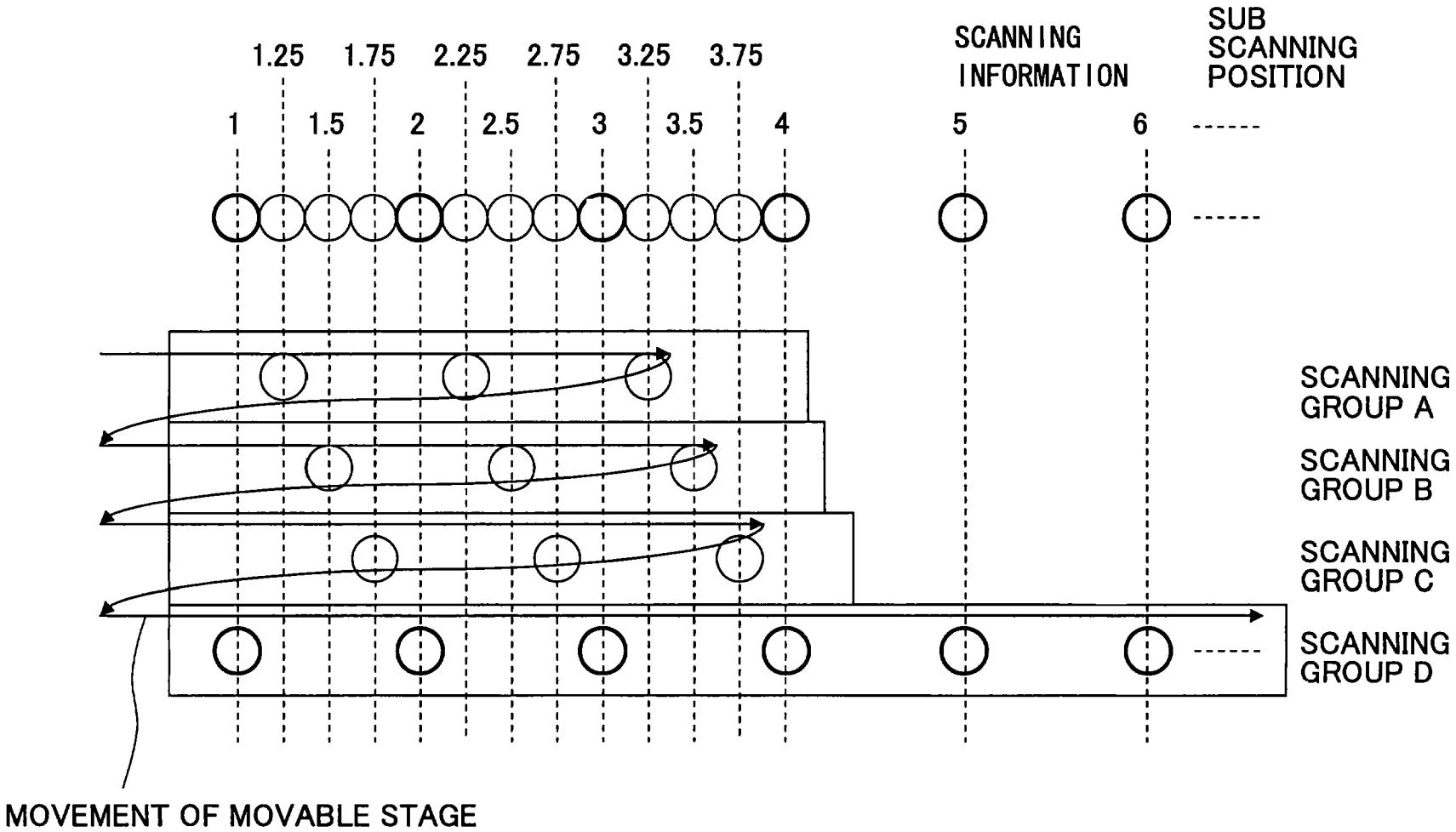
FIG. 23 is an explanatory diagram of a third embodiment according to the present invention.

As shown in FIG. 23, the scanning information is divided into four scanning groups. The first scanning group A includes L[2]=1.25, L[6]=2.25, L[10]=3.25, the second scanning group B includes L[3]=1.5, L[7]=2.5, L[11]=3.5, the third scanning group C includes L[4]=1.75, L[8]=2.75, L[12]=3.75, and the fourth scanning group D includes L[1]=1, L[5]=2, L[9]=3, L[13]=4, L[14]=5, L[15]=6. Scanning intervals between scanning information are 1 in all groups. The only differences are start positions.

As shown in FIG. 23, every time one scanning group is recorded, the movable stage is moved backward to the initial position. Then, the image record start position is shifted by ¼ scan before recording the next scanning group.

Based on the scanning positions included in the scanning information, the image data and L are rearranged into the order of being scanned. Thus, a new set of scanning information LN is provided, as LN[1]=L[2]=1.25, LN[2]=L[6]=2.25°, LN[4]=L[10]=3.25, LN[5]=L[3]=1.5, LN[6]=L[7]=2.5, LN[7]=L[11]=3.5, LN[8]=L[4]=1.75, LN[9]=L[8]=2.75, LN[10]=L[12]=3.75, LN[11]=L[1]=1, LN[12]=L[5]=2, LN[13]=L[9]=3, LN[14]=L[13]=4, LN[14]=L[14]=5, LN[15]=L[15]=6, . . . , and is associated with the rearranged image data. In spiral scanning, in order to align scanning positions on the recording body, the movable stage is synchronized with the rotational position of the drum, so that scanning positions can be reproduced. An image recording device sequentially moves the movable stage according to the scanning information LN. The image recording device reads each item of scanning information, one by one. When the image recording device detects that the scanning position indicated by the scanning information is before the previous position, the image recording device temporarily stops the image recording operation, and moves the movable stage backward to a reference position, e.g., the home position. The image recording device moves the movable stage toward the scanning start position at a constant speed, and adjusts the timing with the drum rotation signal, so that the movable stage is aligned with the fractional position for the next scanning position. Then, scanning is started again. When the movable stage reaches the scanning position, the stopped image recording operation is resumed. Plural reference positions can be provided. The movable stage is to be moved backward to the closest reference position from which scanning can be resumed. By providing a reference position on the scanning side before the end position of image recording, at an appropriate distance in which the movable stage can move at a stable speed, the distance can be reduced compared to returning to the home position. Accordingly, the time required for image forming can be reduced.

Figure 24:
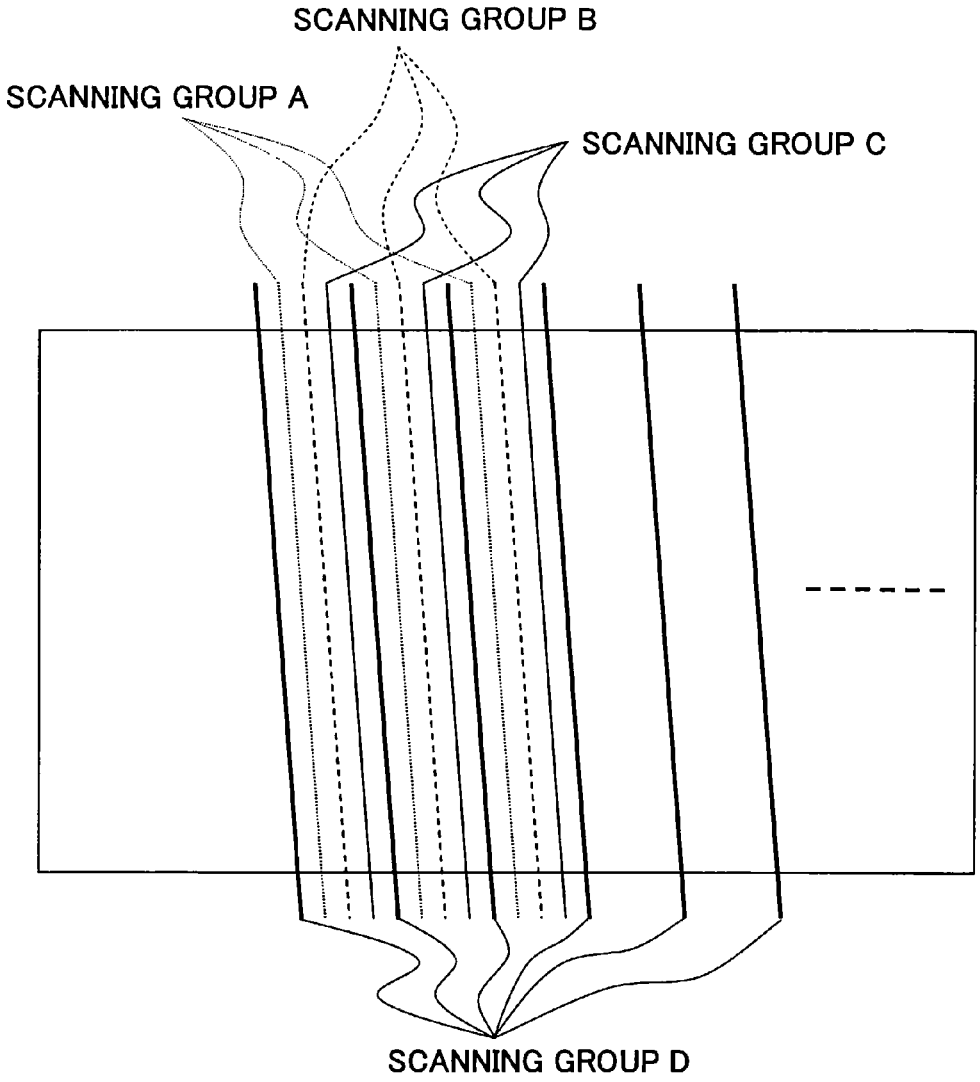
FIG. 24 is another explanatory diagram of the third embodiment.

Scanning can be performed several times while the moving stage is moving backward. Because the scanning intervals are the same, the speed of the movable stage does not change. Accordingly, the slant scanning angle does not change, so that special corrections are unnecessary. An example of a scanning track of one recording beam is shown in FIG. 24.

This method is applicable not only to spiral scanning, but also to other scanning operations such as step scanning. As the scanning intervals can be made equal, the energy required, the workload, and the frictional resistance of mechanical movement are stabilized when the movable stage is moving. Accordingly, errors in the positions of the movable stage can be reduced, so that image quality is less degraded compared to a case of changing the scanning speed.

Fourth Embodiment

In a fourth embodiment, it is assumed that a failure has occurred in the mth recording head of the first embodiment, and a recording beam cannot be irradiated from the mth recording head.

In this case, the mth recording head does not record an image of the original raster image storing region P, and instead, the adjacent recording head records the image for the mth recording head.

Specifically, the mth positional displacement information Δx[m] and the m−1th positional displacement information Δx[m−1] are changed as follows, to obtain a new Δx[m] and a new Δx[m−1]:

$$\text{new } \Delta x[m] = -w,\ \text{new } \Delta x[m-1] = \text{old } \Delta x[m-1] + w + \text{old } \Delta x[m]$$

The recording region of the mth recording head is added to the recording region of the m−1th recording head, so that the recording region of the mth recording head becomes zero. Based on the new positional displacement information, the same processes as those of the first and second embodiments are performed.

Accordingly, the m−1th recording head can form the image that the mth recording head is supposed to record. Image formation can be performed without using the failed mth recording head.

Further, this technology can be used as a method of avoiding degraded image formation when a failure occurs in a recording head.

Similarly, when failures occur in mth and m+1th recording heads, the recording region of the m−1th recording head can be used for recording images of the failed recording heads. However, it is not possible to exceed the region in which the movable stage can move.

In order to ensure that image formation can be continued even when a failure occurs, the movable stage is capable of moving within a region exceeding two times the width of the prescribed recording width w.

Fifth Embodiment

It is difficult to completely match the densities of adjacent recording heads. If the difference in density is large, stripes become apparently visible. By mitigating the difference in density, stripes can be less visible.

Accordingly, in a fifth embodiment according to the present invention, image data corresponding to one recording head are superposed with image data corresponding to an adjacent recording head at a portion of the image data where scanning density is high. Further, rasterized image data (Q) are generated such that a recording beam of one recording head and a recording beam of the adjacent recording head are alternately irradiated to form an image.

Figure 25:
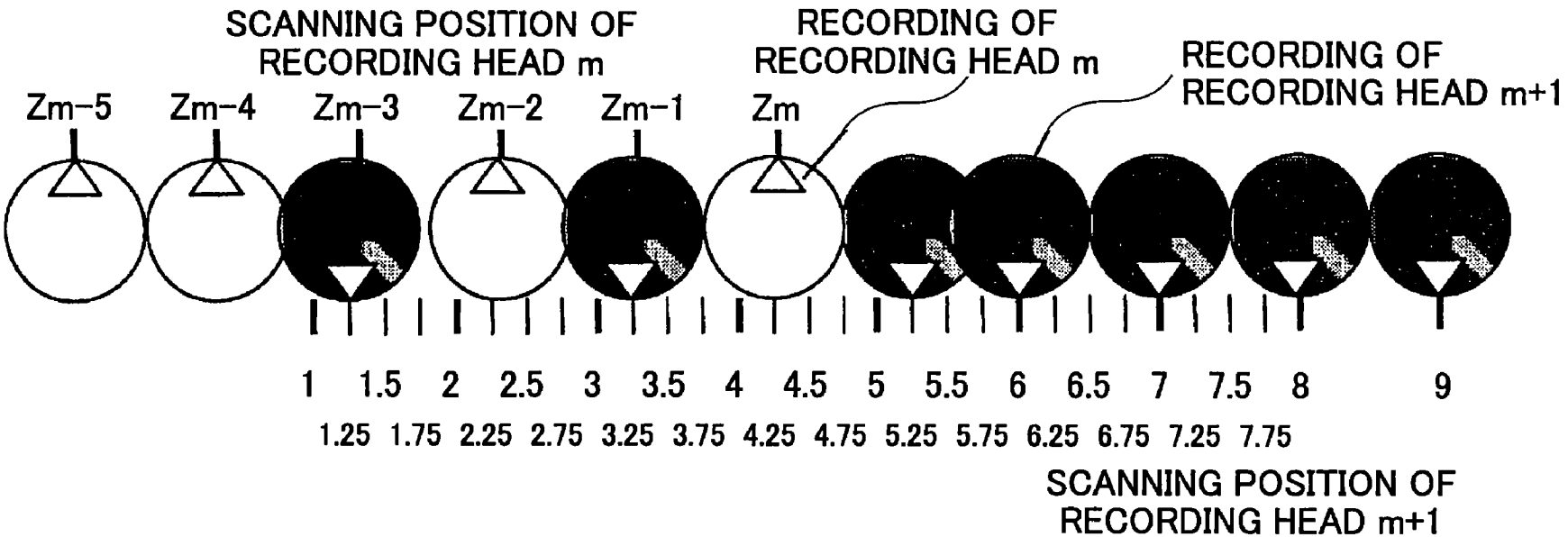
FIG. 25 is an explanatory diagram of a fifth embodiment according to the present invention.

An example is shown in FIG. 25. The last scanning position at which a recording head m records an original raster image is Zm. The area from the scanning position Zm to a scanning position Zm−4 of the recording head m corresponds to the boundary part (fine control area QF) adjacent to another region in the original raster image, as described in the first embodiment. In FIG. 25, three scanning lines scanned by the recording beam m are added (Zm−1, Zm−2, Zm−3).

Further, in the recording image storing region Q shown in FIG. 25, it is assumed that three base widths Nw are added, and four scanning lines are superposed at boundary parts. Three scanning lines are added in each of the fine control areas QF of Zm, Zm−1, Zm−2, Zm−3.

Data indicating that no recording operations are performed are associated with scanning positions Zm-3, Zm−1 of the recording beam m.

Scanning information for the recording beam m+1 is determined in a similar manner to the first embodiment; in this example, data indicating that no recording operations are performed are associated with scanning positions other than 1.25, 3.25, 5.25 and beyond.

The original raster image is recorded alternately at a scanning position Zm−4 of the recording beam m and a scanning position 5.25 of the recording beam m+1; a scanning position Zm−2 of the recording beam m and a scanning position 6.25 of the recording beam m+1; and a scanning position Zm of the recording beam m and a scanning position 7.25 of the recording beam m+1.

Accordingly, inconsecutive portions between image recording positions of adjacent recording beams can be reduced, and large differences in density can be mitigated.

(Variations)

In the above description, the recording beam m is associated with normal scanning, and the recording beam m+1 is associated with additional scanning. However, the recording beams can be associated either way in performing the alternate recording.

Further, in the above description, the image data (Q) are divided into a number of regions corresponding to the number of recording heads; however, the present invention is not limited thereto.

The present invention is not limited to the specifically disclosed embodiment, and variations and expansions may be made without departing from the scope of the present invention.

The present application is based on Japanese Priority Patent Application No. 2005-345872, filed on Nov. 30, 2005, the entire contents of which are hereby incorporated by reference.

The invention claimed is:

1. An image forming apparatus for forming an image corresponding to rasterized original image data by dividing the rasterized original image data into regions in accordance with N (N being an integer greater than or equal to 2) recording heads, and scanning a single recording body by simultaneously irradiating recording beams from the N recording heads, the image forming apparatus comprising:

a positional displacement information storing unit configured to hold positional displacement information including positional displacements of the recording beams of the recording heads;

a rasterized original image data storing unit configured to hold the rasterized original image data;

a corrected image data generating unit configured to generate corrected image data divided into the regions in accordance with the recording heads, the corrected image data being obtained by changing the rasterized original image data held in the rasterized original image data storing unit based on the positional displacement information so that the positional displacements are corrected in a main scanning direction and a sub scanning direction when the recording beams are irradiated; and a scanning information generating unit configured to generate scanning information based on the positional displacement information, the scanning information including positions and orders for the recording beams to scan the recording body to record the corrected image data.

2. The image forming apparatus according to claim 1, wherein the scanning information generating unit generates the scanning information so as to provide a high density area near a scanning start position or a scanning end position, wherein scanning density is higher in the high density area than in other areas scanned, and the corrected image data generating unit generates the corrected image data corresponding to the scanning information generated by the scanning information generating unit.

3. The image forming apparatus according to claim 2, wherein the corrected image data generating unit generates the corrected image data such that one of the regions of the corrected image data corresponding to one of the recording heads and another one of the regions of the corrected image data corresponding to another one of the recording heads adjacent to the one of the recording heads are superposed with each other at the high density area of at least the one of the regions of the corrected image data.

4. The image forming apparatus according to claim 3, wherein the scanning information generating unit generates the scanning information such that scanning intervals are substantially even in the high density area in the corrected image data, and the corrected image data generating unit generates the corrected image data corresponding to the scanning information generated by the scanning information generating unit.

5. The image forming apparatus according to claim 1, wherein the scanning information generating unit generates the scanning information so as to provide a high density area near a scanning start position or a scanning end position, wherein scanning density is higher in the high density area than in other areas scanned, and the corrected image data generating unit generates the corrected image data such that one of the regions of the corrected image data corresponding to one of the recording heads and another one of the regions of the corrected image data corresponding to another one of the recording heads adjacent to the one of the recording heads are superposed with each other at the high density area of the corrected image data, and one of the recording beams from the one of the recording heads and another one of the recording beams from the another one of the recording heads are alternately irradiated.

6. The image forming apparatus according to claim 1, wherein the corrected image data generating unit generates the corrected image data such that when one of the recording heads fails, another one of the recording heads adjacent to the failed recording head irradiates a recording beam instead of the failed recording head.

7. An image forming apparatus for forming an image corresponding to rasterized original image data by dividing the rasterized original image data into regions in accordance with N (N being an integer greater than or equal to 2) recording heads, and scanning a single recording body by simultaneously irradiating recording beams from the N recording heads, the image forming apparatus comprising:

a positional displacement information storing unit configured to hold positional displacement information including positional displacements of the recording beams of the recording heads;

a rasterized original image data storing unit configured to hold the rasterized original image data;

a corrected image data generating unit configured to generate corrected image data divided into the regions in accordance with the recording heads, the corrected image data being obtained by changing the rasterized original image data held in the rasterized original image data storing unit based on the positional displacement information so that the positional displacements are corrected in a main scanning direction and a sub scanning direction when the recording beams are irradiated; and a scanning information generating unit configured to generate scanning information based on the positional displacement information, the scanning information including positions and orders for the recording beams to scan the recording body to record the corrected image data; wherein the scanning information generating unit generates the scanning information so as to provide a high density area near a scanning start position or a scanning end position, wherein scanning density is higher in the high density area than in other areas scanned, additional scanning operations performed for the high density area are extracted and grouped together according to predetermined intervals, and sub scanning operations are performed for each group between performing main scanning operations, the sub scanning operations being performed for the groups at substantially equal speeds.

8. An image forming method of forming an image corresponding to rasterized original image data by dividing the rasterized original image data into regions in accordance with N (N being an integer greater than or equal to 2) recording heads, and scanning a single recording body by simultaneously irradiating recording beams from the N recording heads, the image forming method comprising the steps of:

(a) generating corrected image data divided into regions in accordance with the recording heads, the corrected image data being obtained by changing the rasterized original image data based on previously stored positional displacement information including positional displacements of the recording beams of the recording heads, so that the positional displacements are corrected in a main scanning direction and a sub scanning direction when the recording beams are irradiated; and (b) generating scanning information based on the positional displacement information, the scanning information including positions and orders for the recording beams to scan the recording body to record the corrected image data.

9. The image forming method according to claim 8, wherein the step (b) includes generating the scanning information so as to provide a high density area near a scanning start position or a scanning end position, wherein scanning density is higher in the high density area than in other areas scanned, and the step (a) includes generating the corrected image data corresponding to the scanning information generated at the step (b).

10. The image forming method according to claim 9, wherein the step (a) includes generating the corrected image data such that one of the regions of the corrected image data corresponding to one of the recording heads and another one of the regions of the corrected image data corresponding to another one of the recording heads adjacent to the one of the recording heads are superposed with each other at the high density area of at least the one of the regions of the corrected image data.

11. The image forming method according to claim 10, wherein the step (b) includes generating the scanning information such that scanning intervals are substantially even in the high density area in the corrected image data, and the step (a) includes generating the corrected image data corresponding to the scanning information generated at the step (b).

12. The image forming method according to claim 8, wherein the step (b) includes generating the scanning information so as to provide a high density area near a scanning start position or a scanning end position, wherein scanning density is higher in the high density area than in other areas scanned, and the step (a) includes generating the corrected image data such that one of the regions of the corrected image data corresponding to one of the recording heads and another one of the regions of the corrected image data corresponding to another one of the recording heads adjacent to the one of the recording heads are superposed with each other at the high density area of the corrected image data, and one of the recording beams from the one of the recording heads and another one of the recording beams from the another one of the recording heads are alternately irradiated.

13. The image forming method according to claim 8, wherein the step (a) includes generating the corrected image data such that when one of the recording heads fails, another one of the recording heads adjacent to the failed recording head irradiates a recording beam instead of the failed recording head.

14. An image forming method of forming an image corresponding to rasterized original image data by dividing the rasterized original image data into regions in accordance with N (N being an integer greater than or equal to 2) recording heads, and scanning a single recording body by simultaneously irradiating recording beams from the N recording heads, the image forming method comprising the steps of:

(a) generating corrected image data divided into the regions in accordance with the recording heads, the corrected image data being obtained by changing the rasterized original image data based on previously stored positional displacement information including positional displacements of the recording beams of the recording heads, so that the positional displacements are corrected in a main scanning direction and a sub scanning direction when the recording beams are irradiated; and (b) generating scanning information based on the positional displacement information, the scanning information including positions and orders for the recording beams to scan the recording body to record the corrected image data; wherein the step (b) includes generating the scanning information so as to provide a high density area near a scanning start position or a scanning end position, wherein scanning density is higher in the high density area than in other areas scanned, additional scanning operations performed for the high density area are extracted and grouped together according to predetermined intervals, and sub scanning operations are performed for each group between performing main scanning operations, the sub scanning operations being performed for the groups at substantially equal speeds.

15. A storage medium storing a non-transitory computer program that causes a computer to execute the image forming method according to claim 8.

* * * * *